US009593635B2

(12) United States Patent
Nakagawa et al.

(10) Patent No.: US 9,593,635 B2
(45) Date of Patent: Mar. 14, 2017

(54) CONTROL SYSTEM OF INTERNAL COMBUSTION ENGINE

(71) Applicants: Norihisa Nakagawa, Susono (JP); Shuntaro Okazaki, Shizuoka (JP); Yuji Yamaguchi, Susono (JP)

(72) Inventors: Norihisa Nakagawa, Susono (JP); Shuntaro Okazaki, Shizuoka (JP); Yuji Yamaguchi, Susono (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 1 day.

(21) Appl. No.: 14/763,653

(22) PCT Filed: Jan. 29, 2013

(86) PCT No.: PCT/JP2013/051908
§ 371 (c)(1),
(2) Date: Jul. 27, 2015

(87) PCT Pub. No.: WO2014/118889
PCT Pub. Date: Aug. 7, 2014

(65) Prior Publication Data
US 2016/0017831 A1 Jan. 21, 2016

(51) Int. Cl.
*F01N 3/00* (2006.01)
*F02D 41/14* (2006.01)
*F02D 41/02* (2006.01)

(52) U.S. Cl.
CPC ..... *F02D 41/1475* (2013.01); *F02D 41/0295* (2013.01); *F02D 41/1439* (2013.01); *F02D 41/1477* (2013.01)

(58) Field of Classification Search
CPC ..... F02D 41/0295; F02D 41/1439; F02D 41/1475; F02D 41/1477
See application file for complete search history.

(56) References Cited

U.S. PATENT DOCUMENTS 5,390,489 A 2/1995 Kawai et al.
5,537,817 A * 7/1996 Akazaki ..... F02D 41/1495 60/276

(Continued)

FOREIGN PATENT DOCUMENTS

EP 1529944 A1 5/2005
JP H06-129283 A 5/1994

(Continued)

*Primary Examiner* — Thomas Denion
*Assistant Examiner* — Matthew T Largi
(74) *Attorney, Agent, or Firm* — Andrews Kurth Kenyon LLP

(57) ABSTRACT

A control device for an internal combustion engine, equipped with: an exhaust purification catalyst capable of storing oxygen; a downstream-side air-fuel ratio sensor arranged downstream in the direction of flow of exhaust from the exhaust purification catalyst; and an air-fuel ratio control device that controls the air-fuel ratio such that air-fuel ratio of the exhaust flowing into the exhaust purification catalyst reaches a target air-fuel ratio. The control device changes the target air-fuel ratio to a lean air-fuel ratio setting when the exhaust air-fuel ratio detected by the downstream-side air-fuel ratio sensor reaches a rich air-fuel ratio, and then changes the target air-fuel ratio to a slightly lean air-fuel ratio setting before the exhaust air-fuel ratio detected by the downstream-side air-fuel ratio sensor reaches a lean air-fuel ratio, and then changes the target air-fuel ratio to a rich air-fuel ratio setting when the exhaust air-fuel ratio detected by the downstream-side air-fuel ratio sensor reaches a lean air-fuel ratio, and then changes the target air-fuel ratio to a slightly rich air-fuel ratio setting before the exhaust air-fuel ratio detected by the downstream-side air-fuel ratio sensor reaches a rich air-fuel ratio.

18 Claims, 14 Drawing Sheets

(56) References Cited

U.S. PATENT DOCUMENTS

| | | | | |
|---|---|---|---|---|
| 5,758,490 | A | 6/1998 | Maki et al. | |
| 6,438,946 | B1 * | 8/2002 | Majima | F02D 41/1441 60/276 |
| 6,530,214 | B2 * | 3/2003 | Ikemoto | F02D 41/0235 60/276 |
| 6,904,751 | B2 * | 6/2005 | Makki | F01N 11/002 60/274 |
| 7,266,440 | B2 * | 9/2007 | Ikemoto | F02D 41/0235 60/276 |
| 7,549,283 | B2 * | 6/2009 | Kerns | F01N 11/007 60/276 |
| 2010/0146936 | A1 | 6/2010 | Sawada | |

FOREIGN PATENT DOCUMENTS

| | | | |
|---|---|---|---|
| JP | H08-232723 | A | 9/1996 |
| JP | H08-312408 | A | 11/1996 |
| JP | 2000-356618 | A | 12/2000 |
| JP | 2001-234787 | A | 8/2001 |
| JP | 2003-049681 | A | 2/2003 |
| JP | 2005-140000 | A | 6/2005 |
| JP | 2009-162139 | A | 7/2009 |
| JP | 2011-069337 | A | 4/2011 |

* cited by examiner (A)

(B)

(A)

(B)

(C)

CONTROL SYSTEM OF INTERNAL COMBUSTION ENGINE

CROSS-REFERENCE TO RELATED APPLICATION

This is a national phase application based on the PCT International Patent Application No. PCT/JP2013/051908 filed Jan. 29, 2013, the entire contents of which are incorporated herein by reference.

TECHNICAL FIELD

The present invention relates to a control system of an internal combustion engine which controls an internal combustion engine in accordance with the output of an air-fuel ratio sensor.

BACKGROUND ART

In the past, a control system of an internal combustion engine which is provided with an air-fuel ratio sensor at an exhaust passage of the internal combustion engine and controls the amount of fuel fed to the internal combustion engine based on the output of this air-fuel ratio sensor, has been widely known (for example, see PTLs 1 to 9).

In the internal combustion engines described in PTLs 1 to 4, an exhaust purification catalyst which is provided in the exhaust passage and has an oxygen storage ability is used. An exhaust purification catalyst which has an oxygen storage ability can remove the unburned gas (HC, CO, etc.), $NO_X$, etc., in the exhaust gas flowing into the exhaust purification catalyst, when the oxygen storage amount is a suitable amount between an upper limit storage amount and a lower limit storage amount. That is, if exhaust gas of an air-fuel ratio at a rich side from the stoichiometric air-fuel ratio (below, also called a "rich air-fuel ratio") flows into the exhaust purification catalyst, the unburned gas in the exhaust gas is oxidized and purified by the oxygen stored in the exhaust purification catalyst. Conversely, if exhaust gas of an air-fuel ratio at a lean side from the stoichiometric air-fuel ratio (below, also called a "lean air-fuel ratio") flows into the exhaust purification catalyst, the oxygen in the exhaust gas is stored in the exhaust purification catalyst. Due to this, the surface of the exhaust purification catalyst becomes an oxygen deficient state. Therefore, the $NO_X$ in the exhaust gas is reduced and purified. As a result, the exhaust purification catalyst can purify the exhaust gas regardless of the air-fuel ratio of the exhaust gas flowing into the exhaust purification catalyst so long as the oxygen storage amount is a suitable amount.

Therefore, to maintain the oxygen storage amount in the exhaust purification catalyst at a suitable amount, the control system described in PTLs 1 to 4 is provided with an air-fuel ratio sensor at the upstream side of the exhaust purification catalyst in the direction of flow of exhaust and is provided with an oxygen sensor at the downstream side in the direction of flow of exhaust. By using these sensors, the control system performs feedback control based on the output of the upstream side air-fuel ratio sensor so that the output of this air-fuel ratio sensor becomes a target value which corresponds to a target air-fuel ratio. In addition, a target value of the upstream side air-fuel ratio sensor is corrected based on the output of the downstream side oxygen sensor. Note that, in the following explanation, the upstream side in the direction of flow of exhaust will sometimes simply be referred to as the "upstream side", and the downstream side in the direction of flow of exhaust will sometimes simply be referred to as the "downstream side".

For example, in the control system described in PTL 1, when the output voltage of the downstream side oxygen sensor is a high side threshold value or more and thus the state of the exhaust purification catalyst is an oxygen deficient state, the target air-fuel ratio of the exhaust gas flowing into the exhaust purification catalyst is set to a lean air-fuel ratio. Conversely, when the output voltage of the downstream side oxygen sensor is the low side threshold value or less and thus the state of the exhaust purification catalyst is an oxygen excess state, the target air-fuel ratio is set to the rich air-fuel ratio. According to PTL 1, due to this, when in the oxygen deficient state or oxygen excess state, it is considered that the state of the exhaust purification catalyst can be quickly returned to an intermediate state between these two states (that is, a state where the exhaust purification catalyst stores a suitable amount of oxygen).

In addition, in the above control system, if the output voltage of the downstream side oxygen sensor is between the high side threshold value and the low side threshold value, when the output voltage of the oxygen sensor tends to increase, the target air-fuel ratio is set to the lean air-fuel ratio. Conversely, when the output voltage of the oxygen sensor tends to decrease, the target air-fuel ratio is set to the rich air-fuel ratio. According to PTL 1, due to this, it is considered possible to prevent in advance the state of the exhaust purification catalyst from becoming an oxygen deficient state or oxygen excess state.

CITATIONS LIST

Patent Literature

PTL 1: Japanese Patent Publication No. 2011-069337 A
PTL 2: Japanese Patent Publication No. H8-232723 A
PTL 3: Japanese Patent Publication No. 2009-162139 A
PTL 4: Japanese Patent Publication No. 2001-234787 A
PTL 5: Japanese Patent Publication No. H8-312408 A
PTL 6: Japanese Patent Publication No. H6-129283 A
PTL 7: Japanese Patent Publication No. 2005-140000 A
PTL 8: Japanese Patent Publication No. 2003-049681 A
PTL 9: Japanese Patent Publication No. 2000-356618 A

SUMMARY OF INVENTION

Technical Problem

FIG. 2 shows the relationship between the oxygen storage amount of the exhaust purification catalyst and the concentration of $NO_X$ or unburned gas of the exhaust gas flowing out from the exhaust purification catalyst. FIG. 2(A) shows the relationship between the oxygen storage amount and the $NO_X$ concentration in the exhaust gas flowing out from the exhaust purification catalyst, when the air-fuel ratio of the exhaust gas flowing into the exhaust purification catalyst is the lean air-fuel ratio. On the other hand, FIG. 2(B) shows the relationship between the oxygen storage amount and the concentration of unburned gas in the exhaust gas flowing out from the exhaust purification catalyst, when the air-fuel ratio of the exhaust gas flowing into the exhaust purification catalyst is the rich air-fuel ratio.

As will be understood from FIG. 2(A), when the oxygen storage amount of the exhaust purification catalyst is small, there is leeway until the maximum oxygen storage amount. Therefore, even when the air-fuel ratio of the exhaust gas flowing into the exhaust purification catalyst is the lean air-fuel ratio (that is, this exhaust gas flowing into the exhaust purification catalyst includes $NO_X$ and oxygen), the oxygen in the exhaust gas is stored in the exhaust purification catalyst. Along with this, $NO_X$ is reduced and purified. As a result, the exhaust gas flowing out from the exhaust purification catalyst does not contain much $NO_X$ at all.

However, if the oxygen storage amount of the exhaust purification catalyst becomes greater, when the air-fuel ratio of the exhaust gas flowing into the exhaust purification catalyst is the lean air-fuel ratio, it becomes harder to store the oxygen in the exhaust gas, in the exhaust purification catalyst. Along with this, it becomes harder for the $NO_X$ in the exhaust gas to also be reduced and purified. Therefore, as will be understood from FIG. 2(A), if the oxygen storage amount increases beyond a certain upper limit storage amount Cuplim, the concentration of $NO_X$ in the exhaust gas flowing out from the exhaust purification catalyst rapidly rises.

On the other hand, when the oxygen storage amount of the exhaust purification catalyst is large, if the air-fuel ratio of the exhaust gas flowing into the exhaust purification catalyst is the rich air-fuel ratio (that is, the exhaust gas includes HC or CO or other unburned gas), the oxygen stored in the exhaust purification catalyst is released. Therefore, the unburned gas in the exhaust gas flowing into the exhaust purification catalyst is oxidized and purified. As a result, as will be understood from FIG. 2(B), the exhaust gas flowing out from the exhaust purification catalyst does not contain almost any unburned gas as well.

However, if the oxygen storage amount of the exhaust purification catalyst becomes smaller, when the air-fuel ratio of the exhaust gas flowing into the exhaust purification catalyst is a rich air-fuel ratio, the oxygen released from the exhaust purification catalyst becomes smaller. Along with this, it is more difficult for the unburned gas in the exhaust gas to be oxidized and purified. Therefore, as will be understood from FIG. 2(B), if the oxygen storage amount decreases over a certain lower limit storage amount Clowlim, the concentration of the unburned gas in the exhaust gas flowing out from the exhaust purification catalyst rapidly rises.

The oxygen storage amount of the exhaust purification catalyst and the unburned gas concentration and $NO_X$ concentration in the exhaust gas flowing out from the exhaust purification catalyst have the above-mentioned relationship. In this regard, in the control system described in PTL 1, when the output voltage of the downstream side oxygen sensor is the high side threshold value or more, that is, when the air-fuel ratio of the exhaust gas (below, referred to as the "exhaust air-fuel ratio") which is detected by the downstream side oxygen sensor has become a lower limit air-fuel ratio, which corresponds to the high side threshold value, or less, the target air-fuel ratio is switched to a given lean air-fuel ratio (below, referred to as the "set lean air-fuel ratio"), and then is fixed to that air-fuel ratio. On the other hand, when the output voltage of the downstream side oxygen sensor is the low side threshold value or less, that is, when the exhaust air-fuel ratio detected by the downstream side oxygen sensor has become the upper limit air-fuel ratio, which corresponds to the low side threshold value, or more, the target air-fuel ratio is switched to the given rich air-fuel ratio (below, referred to as "set rich air-fuel ratio"), and then is fixed to that air-fuel ratio.

In this regard, when the exhaust air-fuel ratio detected by the downstream side oxygen sensor is a low limit air-fuel ratio, which corresponds to the high side threshold value, or less, a certain extent of unburned gas flows out from the exhaust purification catalyst. Therefore, if the difference between the set lean air-fuel ratio and the stoichiometric air-fuel ratio, that is, the lean degree of the set lean air-fuel ratio, is set large, it is possible to quickly suppress the outflow of unburned gas from the exhaust purification catalyst. However, if the lean degree of the set lean air-fuel ratio is set large, after that, the oxygen storage amount of the exhaust purification catalyst rapidly increases and the time period until $NO_X$ flows out from the exhaust purification catalyst becomes shorter. In addition, the amount of outflow of $NO_X$ when $NO_X$ flows out from the exhaust purification catalyst becomes greater.

On the other hand, if the lean degree of the set lean air-fuel ratio is set small, the oxygen storage amount of the exhaust purification catalyst can be gradually increased, and therefore the time until $NO_X$ flows out from the exhaust purification catalyst can be longer. In addition, the amount of outflow of $NO_X$ when $NO_X$ flows out from the exhaust purification catalyst can be a small amount. However, in the case where the lean degree of the set lean air-fuel ratio is set small, when the exhaust air-fuel ratio detected by the downstream side oxygen sensor becomes the lower limit air-fuel ratio or less, and thus the target air-fuel ratio is switched from the set rich air-fuel ratio to the set lean air-fuel ratio, it is no longer possible to quickly suppress the outflow of unburned gas from the exhaust purification catalyst.

Further, when the exhaust air-fuel ratio detected by the downstream side oxygen sensor becomes an upper limit air-fuel ratio, which corresponds to the low side threshold value, or more, a certain extent of $NO_X$ flows out from the exhaust purification catalyst. Therefore, if the difference between the set rich air-fuel ratio and the stoichiometric air-fuel ratio, that is, the rich degree, is set large, it is possible to quickly suppress the outflow of $NO_X$ from the exhaust purification catalyst. However, if the rich degree of the set rich air-fuel ratio is set large, after that, the oxygen storage amount of the exhaust purification catalyst rapidly decreases and the time period until unburned gas flows out from the exhaust purification catalyst becomes shorter. In addition, the amount of outflow of unburned gas when unburned gas flows out from the exhaust purification catalyst becomes greater.

On the other hand, if the rich degree of the set rich air-fuel ratio is set small, the oxygen storage amount of the exhaust purification catalyst can be gradually decreased, and thereby the time until unburned gas flows out from the exhaust purification catalyst can be longer. In addition, the amount of outflow of unburned gas when unburned gas flows out from the exhaust purification catalyst can be a small amount. However, in the case where the rich degree of the set rich air-fuel ratio is set small, when the exhaust air-fuel ratio detected by the downstream side oxygen sensor becomes the upper limit air-fuel ratio or more, and thus the target air-fuel ratio is switched from the set lean air-fuel ratio to the set rich air-fuel ratio, the outflow of $NO_X$ from the exhaust purification catalyst can no longer be quickly suppressed.

In addition, in the control system described in PTL 1, an oxygen sensor is used at the downstream side, in the direction of flow of exhaust, of the exhaust purification catalyst. The relationship between the exhaust air-fuel ratio and output voltage in the oxygen sensor basically becomes a relationship shown by the broken line of FIG. 3. That is, the electromotive force greatly changes near the stoichiometric air-fuel ratio. If the exhaust air-fuel ratio becomes the rich air-fuel ratio, the electromotive force becomes higher, while if the exhaust air-fuel ratio conversely becomes the lean air-fuel ratio, the electromotive force becomes lower.

However, in an oxygen sensor, the reactivity of unburned gas, oxygen, etc., on the electrodes of the sensor is low, and therefore even if the actual exhaust air-fuel ratio is the same, the electromotive force will differ in value in accordance with the direction of change of the air-fuel ratio. In other words, an oxygen sensor has hysteresis in accordance with the direction of change of the exhaust air-fuel ratio. FIG. 3 shows this state. The solid line A shows the relationship when making the air-fuel ratio change from the rich side to the lean side, while the solid line B shows the relationship when making the air-fuel ratio change from the lean side to the rich side.

Therefore, when arranging an oxygen sensor at the downstream side, in the direction of flow of exhaust, of the exhaust purification catalyst, it is only after the actual exhaust air-fuel ratio changes by a certain extent from the stoichiometric air-fuel ratio to the rich side that the oxygen sensor detects the rich air-fuel ratio. Similarly, it is only after the actual exhaust air-fuel ratio changes by a certain extent from the stoichiometric air-fuel ratio to the lean side that the oxygen sensor detects the lean air-fuel ratio. That is, when arranging an oxygen sensor at the downstream side, the response to the actual exhaust air-fuel ratio is low. If, in this way, the response of the downstream side oxygen sensor is low, the target air-fuel ratio is switched to the rich air-fuel ratio after $NO_X$ flows out from the exhaust purification catalyst by a certain extent. Further, the target air-fuel ratio is switched to the lean air-fuel ratio after unburned gas flows out from the exhaust purification catalyst by a certain extent.

In this way, according to the control system described in PTL 1, it was not possible to sufficiently decrease the unburned gas or $NO_X$ which flows out from the exhaust purification catalyst.

Therefore, in view of the above problem, an object of the present invention is to provide a control system of an internal combustion engine which can sufficiently decrease the unburned gas or $NO_X$ which flows out from the exhaust purification catalyst.

Solution to Problem

To solve the above problem, in a first aspect of the invention, there is provided a control system of an internal combustion engine, which comprises: an exhaust purification catalyst which is arranged in an exhaust passage of the internal combustion engine and which can store oxygen; a downstream side air-fuel ratio detection device which is arranged at a downstream side, in the direction of flow of exhaust, of the exhaust purification catalyst and which detects the air-fuel ratio of the exhaust gas which flows out from the exhaust purification catalyst, and an air-fuel ratio control system which controls the air-fuel ratio of the exhaust gas so that the air-fuel ratio of the exhaust gas flowing into the exhaust purification catalyst becomes a target air-fuel ratio, the control system comprising: an air-fuel ratio lean switching means for changing the target air-fuel ratio to a lean set air-fuel ratio which is leaner than a stoichiometric air-fuel ratio, when an exhaust air-fuel ratio detected by the downstream side air-fuel ratio detection device becomes a rich air-fuel ratio; a lean degree lowering means for changing the target air-fuel ratio to a lean air-fuel ratio with a smaller difference from the stoichiometric air-fuel ratio than the lean set air-fuel ratio, at a timing after the air-fuel ratio lean switching means changes the air-fuel ratio and before the exhaust air-fuel ratio detected by the downstream side air-fuel ratio detection device becomes the lean air-fuel ratio; an air-fuel ratio rich switching means for changing the target air-fuel ratio to a rich set air-fuel ratio which is richer than the stoichiometric air-fuel ratio, when the exhaust air-fuel ratio detected by the downstream side air-fuel ratio detection device becomes the lean air-fuel ratio; and a rich degree lowering means for changing the target air-fuel ratio to a rich air-fuel ratio with a smaller difference from the stoichiometric air-fuel ratio than the rich set air-fuel ratio, at a timing after the air-fuel ratio lean switching means changes the air-fuel ratio and before the exhaust air-fuel ratio detected by the downstream side air-fuel ratio detection device becomes the rich air-fuel ratio.

In a second aspect of the invention, there is provided the first aspect of the invention, wherein when changing the target air-fuel ratio change, the lean degree lowering means switches the target air-fuel ratio in step from the lean set air-fuel ratio to the given lean air-fuel ratio with a smaller difference from the stoichiometric air-fuel ratio than the lean set air-fuel ratio.

In a third aspect of the invention, there is provided the first or second aspect of the invention, wherein when changing the target air-fuel ratio change, the rich degree lowering means switches the target air-fuel ratio in step from the rich set air-fuel ratio to the given rich air-fuel ratio with a smaller difference from the stoichiometric air-fuel ratio than the rich set air-fuel ratio.

In a fourth aspect of the invention, there is provided any one of the first to third aspects of the invention, wherein the lean degree lowering means changes the target air-fuel ratio after the exhaust air-fuel ratio detected by the downstream side air-fuel ratio detection device converges to the stoichiometric air-fuel ratio.

In a fifth aspect of the invention, there is provided any one of the first to fourth aspects of the invention, wherein the rich degree lowering means changes the target air-fuel ratio after the exhaust air-fuel ratio detected by the downstream side air-fuel ratio detection device converges to the stoichiometric air-fuel ratio.

In a sixth aspect of the invention, there is provided any one of the first to third aspects of the invention, further comprising an oxygen storage amount estimating means for estimating the oxygen storage amount of the exhaust purification catalyst, wherein the lean degree lowering means changes the target air-fuel ratio when the oxygen storage amount estimated by the oxygen storage amount estimating means becomes a predetermined storage amount, which is smaller than the maximum oxygen storage amount, or more.

In a seventh aspect of the invention, there is provided any one of the first to fourth aspects of the invention, further comprising an oxygen storage amount estimating means for estimating the oxygen storage amount of the exhaust purification catalyst, wherein the rich degree lowering means changes the target air-fuel ratio when the oxygen storage amount estimated by the oxygen storage amount estimating means becomes a predetermined storage amount, which is larger than zero, or more.

In an eighth aspect of the invention, there is provided the sixth or seventh aspect of the invention, wherein the engine further comprises an upstream side air-fuel ratio detection device which is arranged at an upstream side, in the direction of flow of exhaust, of the exhaust purification catalyst and which detects the exhaust air-fuel ratio of the exhaust gas flowing into the exhaust purification catalyst, wherein the oxygen storage amount estimating means comprises: an inflowing unburned gas excess/deficient flow amount calculating means for calculating the amount of flow of unburned gas becoming excess or unburned gas becoming deficient compared with the case where the air-fuel ratio of the exhaust gas flowing into the exhaust purification catalyst is the stoichiometric air-fuel ratio, based on the air-fuel ratio detected by the upstream side air-fuel ratio detection device and the intake air amount of the internal combustion engine; an outflowing unburned gas excess/deficient flow amount calculating means for calculating the amount of flow of unburned gas becoming excess or unburned gas becoming deficient compared with the case where the air-fuel ratio of the exhaust gas flowing out from the exhaust purification catalyst is the stoichiometric air-fuel ratio, based on the air-fuel ratio detected by the downstream side air-fuel ratio detection device and the intake air amount of the internal combustion engine; and a storage amount calculating means for calculating the oxygen storage amount of the exhaust purification catalyst, based on an amount of flow of excessive/deficient unburned gas which is calculated by the inflowing unburned gas excess/deficient flow amount calculating means and an amount of flow of excessive/deficient unburned gas which is calculated by the outflowing unburned gas excess/deficient flow amount calculating means.

In a ninth aspect of the invention, there is provided the eighth aspect of the invention, further comprising a learning valve calculating means for calculating a learning value of the air-fuel ratio deviation for correcting deviation of the air-fuel ratio of the exhaust gas which actually flows into the exhaust purification catalyst from the target air-fuel ratio, based on the oxygen storage amount which was calculated by the storage amount calculating means from when the air-fuel ratio lean switching means changes the target air-fuel ratio to a lean set air-fuel ratio to when the air-fuel ratio rich switching means changes the target air-fuel ratio change to a maximum rich air-fuel ratio, and the oxygen storage amount which was calculated by the storage amount calculating means from when the air-fuel ratio lean switching means changes the target air-fuel ratio to a rich set air-fuel ratio to when the air-fuel ratio rich switching means changes the target air-fuel ratio to a lean set air-fuel ratio, wherein the air-fuel ratio control system corrects the target air-fuel ratio which was set by the air-fuel ratio lean switching means, the lean degree lowering means, the air-fuel ratio rich switching means, and the rich degree lowering means, based on the learning value of the air-fuel ratio deviation, which was calculated by the learning value calculating means.

In a 10th aspect of the invention, there is provided any one of the first to ninth aspects of the invention, wherein the air-fuel ratio lean switching means judges that the exhaust air-fuel ratio which is detected by the downstream side air-fuel ratio detection device has become the rich air-fuel ratio, when the exhaust air-fuel ratio detected by the downstream side air-fuel ratio detection device becomes a rich judgement air-fuel ratio which is richer than the stoichiometric air-fuel ratio, and the air-fuel ratio rich switching means judges that the exhaust air-fuel ratio which is detected by the downstream side air-fuel ratio detection device has become the lean air-fuel ratio, when the exhaust air-fuel ratio detected by the downstream side air-fuel ratio detection device becomes a lean judgement air-fuel ratio which is leaner than the stoichiometric air-fuel ratio.

In a 11th aspect of the invention, there is provided the 10th aspect of the invention, wherein the downstream side air-fuel ratio detection device is an air-fuel ratio sensor in which applied voltage, when the output current becomes zero, changes in accordance with the exhaust air-fuel ratio, and the air-fuel ratio sensor is supplied with applied voltage whereby the output current becomes zero when the exhaust air-fuel ratio is the rich judgement air-fuel ratio, and the air-fuel ratio lean switching means judges that the exhaust air-fuel ratio has become the rich air-fuel ratio when the output current becomes zero or less.

In a 12th aspect of the invention, there is provided the 10th aspect of the invention, wherein the downstream side air-fuel ratio detection device is an air-fuel ratio sensor in which applied voltage, when the output current becomes zero, changes in accordance with the exhaust air-fuel ratio, and the air-fuel ratio sensor is supplied with applied voltage whereby the output current becomes zero when the exhaust air-fuel ratio is the lean judgement air-fuel ratio, and the air-fuel ratio lean switching means judges that the exhaust air-fuel ratio has become the lean air-fuel ratio when the output current becomes zero or less.

In a 13th aspect of the invention, there is provided any one of the 10th to 12th aspects of the invention, wherein the downstream side air-fuel ratio detection device is an air-fuel ratio sensor in which applied voltage, when the output current becomes zero, changes in accordance with the exhaust air-fuel ratio, and wherein the air-fuel ratio sensor is alternately supplied with applied voltage whereby the output current becomes zero when the exhaust air-fuel ratio is the rich judgement air-fuel ratio and with applied voltage whereby the output current becomes zero when the exhaust air-fuel ratio is the lean judgement air-fuel ratio.

In a 14th aspect of the invention, there is provided any one of the first to 10th aspects of the invention, further comprising an upstream side air-fuel ratio detection device which is arranged at an upstream side, in the direction of flow of exhaust, of the exhaust purification catalyst and which detects the exhaust air-fuel ratio of the exhaust gas flowing into the exhaust purification catalyst, wherein the air-fuel ratio control system controls the amount of fuel or air which is fed to the combustion chamber of the internal combustion engine so that the air-fuel ratio which was detected by the upstream side air-fuel ratio detection device becomes the target air-fuel ratio.

In a 15th aspect of the invention, there is provided the 14th aspect of the invention, wherein the upstream side air-fuel ratio detection device and downstream side air-fuel ratio detection device are air-fuel ratio sensors in which applied voltage, when the output current becomes zero, changes in accordance with the exhaust air-fuel ratio, and wherein the applied voltage at the upstream side air-fuel ratio detection device and the applied voltage the downstream side air-fuel ratio detection device are different values.

In a 16th aspect of the invention, there is provided any one of the first to 15th aspects of the invention, further comprising a downstream side exhaust purification catalyst which is arranged at the downstream side, in the direction of flow of exhaust, of the downstream side air-fuel ratio detection device in the exhaust passage and which can store oxygen.

Advantageous Effects of Invention

According to the control system of an internal combustion engine according to the present invention, it is possible to sufficiently decrease the unburned gas or $NO_X$ which flows out from the exhaust purification catalyst.

DESCRIPTION OF EMBODIMENTS

Figure 1:
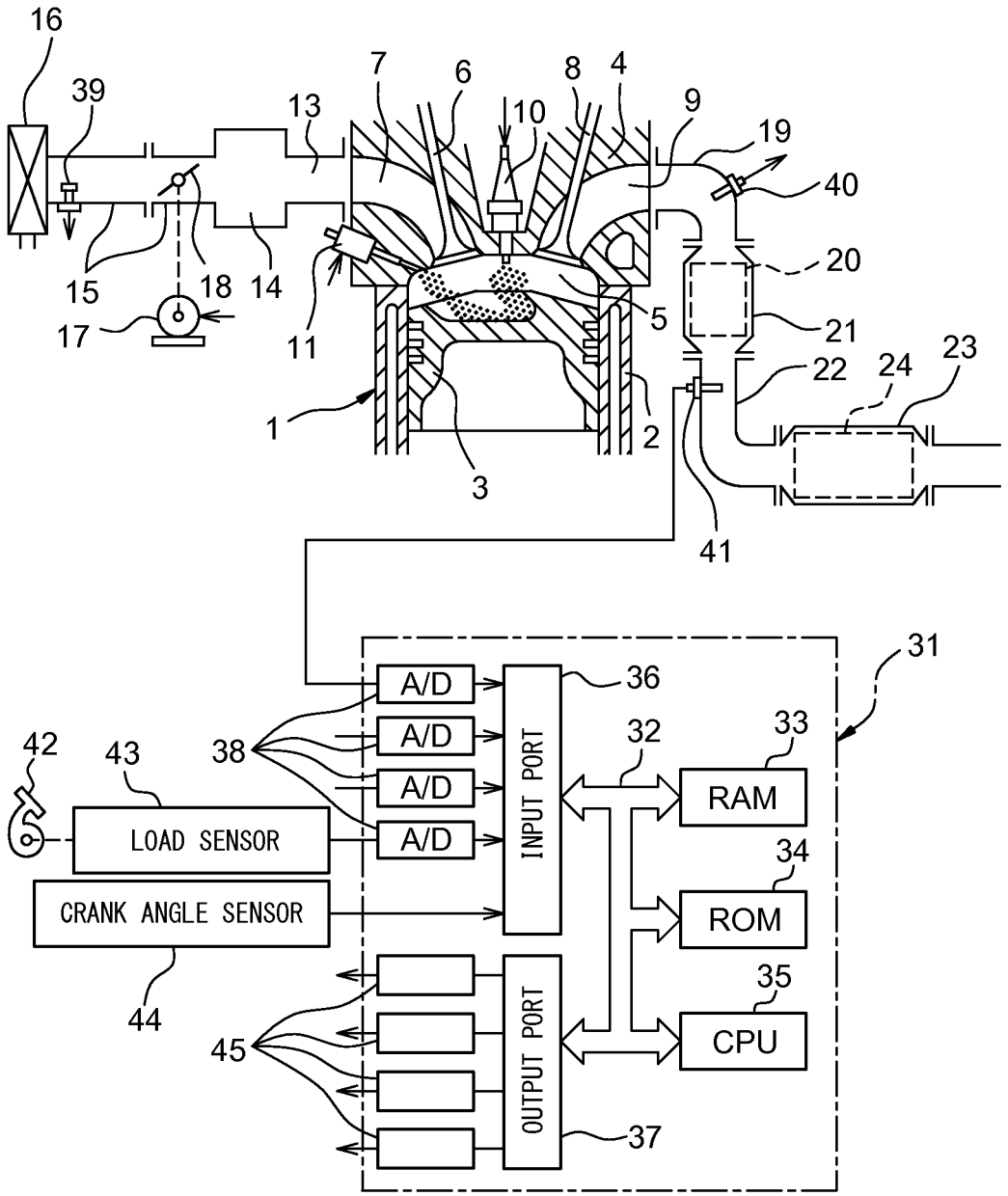
FIG. 1 is a view which schematically shows an internal combustion engine in which a control system of a first embodiment of the present invention is used.

Below, referring to the drawings, a control device of an internal combustion engine of the present invention will be explained in detail. Note that, in the following explanation, similar component elements are assigned the same reference numerals. FIG. 1 is a view which schematically shows an internal combustion engine in which a control device according to a first embodiment of the present invention is used.

<Explanation of Internal Combustion Engine as a Whole>

Referring to FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a side part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 at an exhaust purification catalyst is used. However, the internal combustion engine of the present invention may also use another fuel.

The intake port 7 of each cylinder is connected to a surge tank 14 through a corresponding intake branch pipe 13, while the surge tank 14 is connected to an air cleaner 16 through an intake pipe 15. The intake port 7, intake branch pipe 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of branch pipes which are connected to the exhaust ports 9 and a header at which these branch pipes are collected. The header of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 is arranged for detecting the flow rate of air flowing through the intake pipe 15. The output of this air flow meter 39 is input through a corresponding AD converter 38 to the input port 36. Further, at the header of the exhaust manifold 19, an upstream side air-fuel ratio sensor (upstream side air-fuel ratio detection device) 40 is arranged which detects the air-fuel ratio of the exhaust gas flowing through the inside of the exhaust manifold 19 (that is, the exhaust gas flowing into the upstream side exhaust purification catalyst 20). In addition, in the exhaust pipe 22, a downstream side air-fuel ratio sensor (downstream side air-fuel ratio detection device) 41 is arranged which detects the air-fuel ratio of the exhaust gas flowing through the inside of the exhaust pipe 22 (that is, the exhaust gas flowing out from the upstream side exhaust purification catalyst 20 and flows into the downstream side exhaust purification catalyst 24). The outputs of these air-fuel ratio sensors 40 and 41 are also input through the corresponding AD converters 38 to the input port 36. Note that, the configurations of these air-fuel ratio sensors 40 and 41 will be explained later.

Further, an accelerator pedal 42 has a load sensor 43 connected to it which generates an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that the ECU 31 functions as an engine control device for controlling the internal combustion engine based on the outputs of various sensors, etc.

Note that, the internal combustion engine according to the present embodiment is a nonsupercharged internal combustion engine which is fueled by gasoline, but the configuration of the internal combustion engine according to the present invention is not limited to the above configuration. For example, the internal combustion engine according to the present invention may also differ in number of cylinders, arrangement of cylinders, injection way of fuel, configuration of the intake and exhaust systems, configuration of the valve mechanisms, presence of superchargers, supercharging way, etc., from the above internal combustion engine.

<Explanation of Exhaust Purification Catalyst>

The upstream side exhaust purification catalyst 20 and the downstream side exhaust purification catalyst 24 both have similar configurations. The exhaust purification catalysts 20 and 24 are three-way catalysts which have an oxygen storage ability. Specifically, the exhaust purification catalysts 20 and 24 are formed from carriers made of ceramic on which a precious metal which has a catalytic action (for example, platinum (Pt)) and a substance which has an oxygen storage ability (for example, ceria ($CeO_2$)) are carried. If the exhaust purification catalysts 20 and 24 reach a predetermined activation temperature, it exhibits an oxygen storage ability in addition to the catalytic action of simultaneously removing the unburned gas (HC, CO, etc.) and nitrogen oxides ($NO_X$).

According to the oxygen storage ability of the exhaust purification catalysts 20 and 24, the exhaust purification catalysts 20 and 24 store the oxygen in the exhaust gas, when the air-fuel ratio of the exhaust gas flowing into the exhaust purification catalysts 20 and 24 is leaner than the stoichiometric air-fuel ratio (lean air-fuel ratio). On the other hand, the exhaust purification catalysts 20 and 24 release the oxygen which is stored in the exhaust purification catalysts 20 and 24 when the air-fuel ratio of the inflowing exhaust gas is richer than the stoichiometric air-fuel ratio (rich air-fuel ratio). Note that, the "air-fuel ratio of the exhaust gas" means the ratio of the mass of the fuel to the mass of the air which are fed up to when the exhaust gas is produced. Usually, it means the ratio of the mass of the fuel to the mass of the air which are fed into the combustion chamber 5 when that exhaust gas is produced. Note that in the present specification, an air-fuel ratio of exhaust gas may be referred to as "exhaust air-fuel ratio".

The exhaust purification catalysts 20 and 24 have a catalytic action and oxygen storage ability and thereby has the purifying function of the $NO_X$ and unburned gas in accordance with the oxygen storage amount. That is, as shown in FIG. 2(A), if the air-fuel ratio of the exhaust gas flowing into the exhaust purification catalysts 20 and 24 is the lean air-fuel ratio, when the oxygen storage amount is small, the exhaust purification catalysts 20 and 24 store the oxygen in the exhaust gas, and reduces and purifies the $NO_X$. Further, if the oxygen storage amount becomes greater, the concentrations of the oxygen and $NO_X$ in the exhaust gas flowing out from the exhaust purification catalysts 20 and 24 rapidly rise, starting from the upper limit storage amount Cuplim.

On the other hand, as shown in FIG. 2(B), if the air-fuel ratio of the exhaust gas flowing into the exhaust purification catalysts 20 and 24 is the rich air-fuel ratio, when the oxygen storage amount is large, the oxygen which is stored in the exhaust purification catalysts 20 and 24 is released and the unburned gas in the exhaust gas is oxidized and purified. Further, if the oxygen storage amount becomes small, the concentration of the unburned gas in the exhaust gas flowing out from the exhaust purification catalysts 20 and 24 rapidly rise starting from the lower limit storage amount Clowlim.

As mentioned above, according to the exhaust purification catalysts 20, 24 used in the present embodiment, the characteristic of purification of $NO_X$ and unburned gas in the exhaust gas changes in accordance with the air-fuel ratio of the exhaust gas flowing into the exhaust purification catalysts 20, 24 and oxygen storage amount. Note that, as long as the exhaust purification catalysts 20, 24 has a catalytic function and oxygen storage ability, the exhaust purification catalysts 20, 24 may also be catalysts which are different from three-way catalysts.

<Configuration of Air-Fuel Ratio Sensor>

Figure 4:
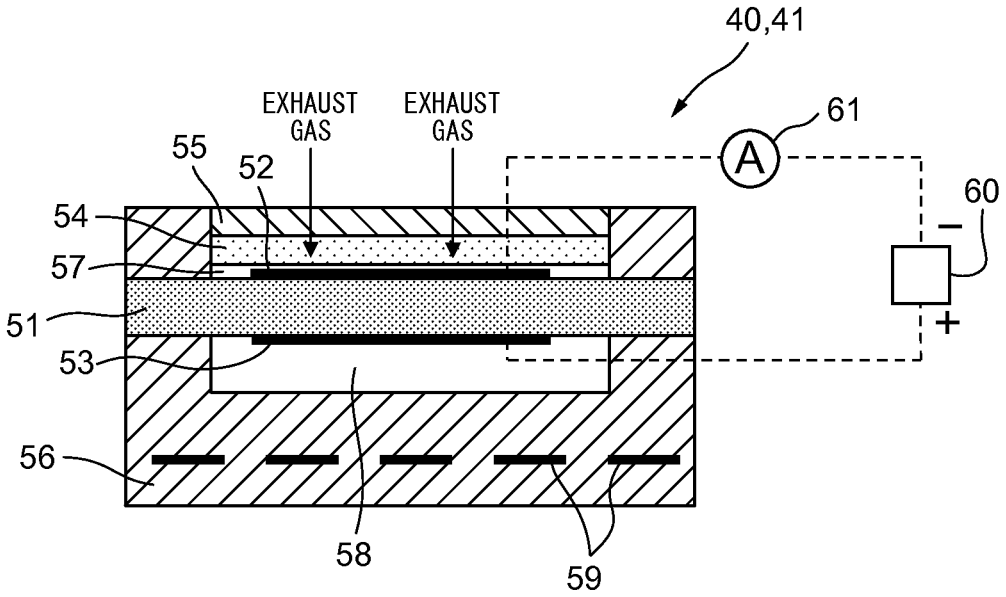
FIG. 4 is a schematic cross-sectional view of a downstream side air-fuel ratio sensor.

Next, referring to FIG. 4, the configurations of air-fuel ratio sensors 40 and 41 in the present embodiment will be explained. FIG. 4 is a schematic cross-sectional view of air-fuel ratio sensors 40 and 41. As will be understood from FIG. 4, the air-fuel ratio sensors 40 and 41 in the present embodiment are single-cell type air-fuel ratio sensors each comprised of a solid electrolyte layer and a pair of electrodes forming a single cell.

As shown in FIG. 4, each of the air-fuel ratio sensors 40 and 41 is provided with a solid electrolyte layer 51, an exhaust side electrode (first electrode) 52 which is arranged at one lateral surface of the solid electrolyte layer 51, an atmosphere side electrode (second electrode) 53 which is arranged at the other lateral surface of the solid electrolyte layer 51, a diffusion regulation layer 54 which regulates the diffusion of the passing exhaust gas, a catalytic layer 55 which reacts Oxygen and unburned gas in the exhaust gas, and a heater part 56 which heats the air-fuel ratio sensor 40 or 41.

On one lateral surface of the solid electrolyte layer 51, a diffusion regulation layer 54 is provided. On the lateral surface of the diffusion regulation layer 54 at the opposite side from the lateral surface of the solid electrolyte layer 51 side, a catalytic layer 55 is provided. In the present embodiment, a measured gas chamber 57 is formed between the solid electrolyte layer 51 and the diffusion regulation layer 54. In this measured gas chamber 57, the gas to be detected by the air-fuel ratio sensors 40 and 41, that is, the exhaust gas, is introduced through the diffusion regulation layer 54. Further, the exhaust side electrode 52 is arranged inside the measured gas chamber 57, therefore, the exhaust side electrode 52 is exposed to the exhaust gas through the diffusion regulation layer 54. Note that, the measured gas chamber 57 does not necessarily have to be provided. The diffusion regulation layer 54 may directly contact the surface of the exhaust side electrode 52.

On the other lateral surface of the solid electrolyte layer 51, the heater part 56 is provided. Between the solid electrolyte layer 51 and the heater part 56, a reference gas chamber 58 is formed. Inside this reference gas chamber 58, a reference gas is introduced. In the present embodiment, the reference gas chamber 58 is open to the atmosphere. Therefore, inside the reference gas chamber 58, the atmosphere is introduced as the reference gas. The atmosphere side electrode 53 is arranged inside the reference gas chamber 58, therefore, the atmosphere side electrode 53 is exposed to the reference gas (reference atmosphere). In the present embodiment, atmospheric air is used as the reference gas, so the atmosphere side electrode 53 is exposed to the atmosphere.

The heater part 56 is provided with a plurality of heaters 59. These heaters 59 can be used to control the temperature of the air-fuel ratio sensor 40 or 41, in particular, the temperature of the solid electrolyte layers 51. The heater part 56 has a sufficient heat generation capacity for heating the solid electrolyte layer 51 until activating.

The solid electrolyte layer 51 is formed by a sintered body of $ZrO_2$ (zirconia), $HfO_2$, $ThO_2$, $Bi_2O_2$, or other oxygen ion conducting oxide in which CaO, MgO, $Y_2O_3$, $Yb_2O_2$, etc. is blended as a stabilizer. Further, the diffusion regulation layer 54 is formed by a porous sintered body of alumina, magnesia, silica, spinel, mullite, or another heat resistant inorganic substance. Furthermore, the electrodes 52 and 53 are formed by platinum or other precious metal with a high catalytic activity.

Further, between the exhaust side electrode 52 and the atmosphere side electrode 53, sensor voltage Vr is supplied by the voltage application device 60 which is mounted on the ECU 31. In addition, the ECU 31 is provided with a current detection device 61 which detects the current (output current) which flows between these electrodes 52 and 53 through the solid electrolyte layer 51 when the voltage application device 60 supplies the sensor voltage Vr. The current which is detected by this current detection device 61 is the output current of the air-fuel ratio sensors 40 and 41.

<Operation of Air-Fuel Ratio Sensor>

Figure 5:
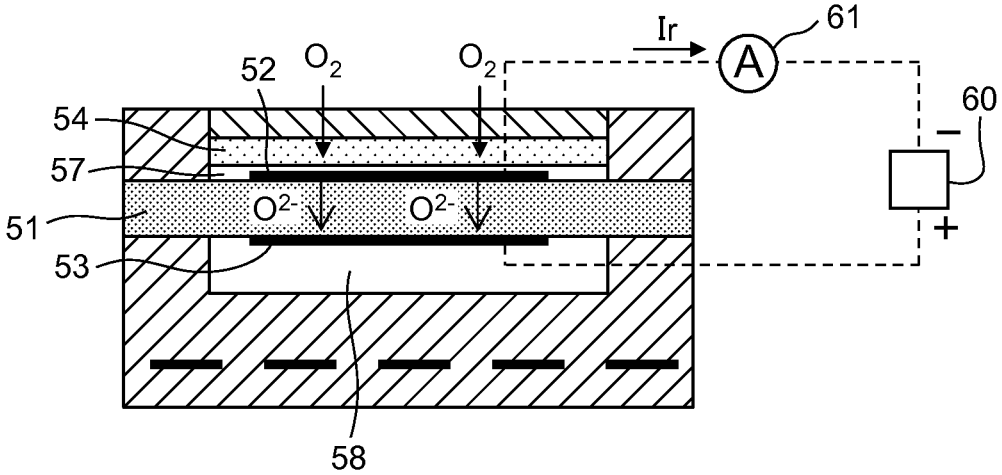
FIG. 5 is a view which schematically shows an operation of a downstream side air-fuel ratio sensor.
Figure 5:
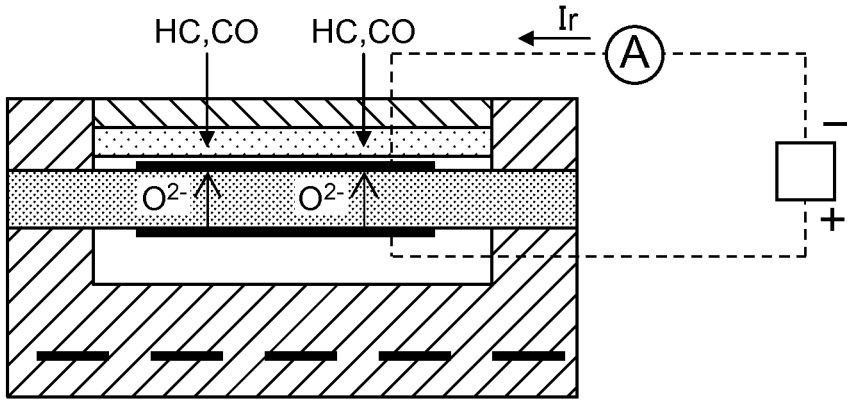
Figure 5:
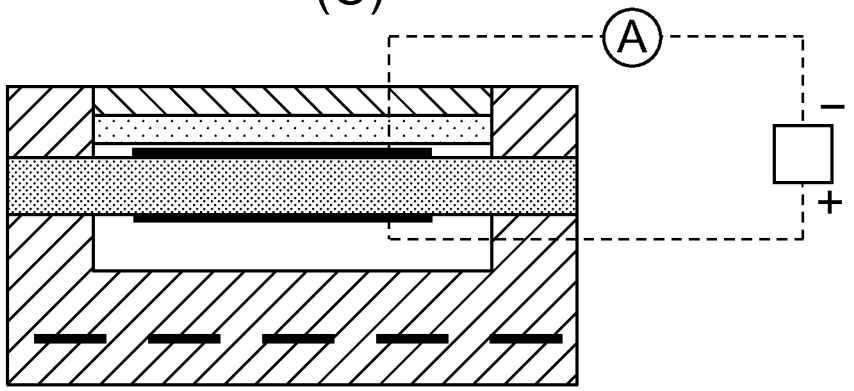

Next, referring to FIG. 5, the basic concept of the operation of the thus configured air-fuel ratio sensors 40, 41 will be explained. FIG. 5 is a view which schematically shows the operation of the air-fuel ratio sensors 40, 41. At the time of use, each of the air-fuel ratio sensors 40, 41 is arranged so that the catalytic layer 55 and the outer circumferential surface of the diffusion regulating layer 54 are exposed to the exhaust gas. Further, atmospheric air is introduced into the reference gas chamber 58 of the air-fuel ratio sensors 40, 41.

In the above-mentioned way, the solid electrolyte layer 51 is formed by a sintered body of an oxygen ion conductive oxide. Therefore, it has the property of an electromotive force E being generated which makes oxygen ions move from the high concentration lateral surface side to the low concentration lateral surface side if a difference occurs in the oxygen concentration between the two lateral surfaces of the solid electrolyte layer 51 in the state activated by the high temperature (oxygen cell characteristic).

Conversely, if a potential difference occurs between the two lateral surfaces, the solid electrolyte layer 51 has the characteristic of trying to make the oxygen ions move so that a ratio of oxygen concentration occurs between the two lateral surfaces of the solid electrolyte layer in accordance with the potential difference (oxygen pump characteristic). Specifically, when a potential difference occurs across the two lateral surfaces, movement of oxygen ions is caused so that the oxygen concentration at the lateral surface which has a positive polarity becomes higher than the oxygen concentration at the lateral surface which has a negative polarity, by a ratio according to the potential difference. Further, as shown in FIGS. 4 and 5, in the air-fuel ratio sensors 40, 41, a constant sensor applied voltage Vr is applied across electrodes 52, 53 so that the atmosphere side electrode 53 becomes the positive electrode and the exhaust side electrode 52 becomes the negative electrode. Note that, in the present embodiment, the sensor applied voltages Vr in the air-fuel ratio sensors 40 and 41 are the same voltage as each other.

When the exhaust air-fuel ratio around the air-fuel ratio sensors 40, 41 is leaner than the stoichiometric air-fuel ratio, the ratio of the oxygen concentrations between the two lateral surfaces of the solid electrolyte layer 51 does not become that large. Therefore, if setting the sensor applied voltage Vr at a suitable value, between the two lateral surfaces of the solid electrolyte layer 51, the actual oxygen concentration ratio becomes smaller than the oxygen concentration ratio corresponding to the sensor applied voltage Vr. For this reason, the oxygen ions move from the exhaust side electrode 52 toward the atmosphere side electrode 43 as shown in FIG. 5(A) so that the oxygen concentration ratio between the two lateral surfaces of the solid electrolyte layer 51 becomes larger toward the oxygen concentration ratio corresponding to the sensor applied voltage Vr. As a result, current flows from the positive side of the voltage application device 60 which applies the sensor applied voltage Vr, through the atmosphere side electrode 53, solid electrolyte layer 51, and exhaust side electrode 52, to the negative side of the voltage application device 60.

The magnitude of the current (output current) Ir flowing at this time is proportional to the amount of oxygen flowing by diffusing from the exhaust through the diffusion regulating layer 54 to the measured gas chamber 57, if setting the sensor applied voltage Vr to a suitable value. Therefore, by detecting the magnitude of this current Ir by the current detection device 61, it is possible to learn the oxygen concentration and in turn possible to learn the air-fuel ratio in the lean region.

On the other hand, when the exhaust air-fuel ratio around the air-fuel ratio sensors 40, 41 is richer than the stoichiometric air-fuel ratio, unburned gas flows in from the exhaust through the diffusion regulating layer 54 to the inside of the measured gas chamber 57, and therefore even if there is oxygen present on the exhaust side electrode 52, oxygen reacts with the unburned gas and is removed. Therefore, inside the measured gas chamber 57, the oxygen concentration becomes extremely low. As a result, the ratio of the oxygen concentration between the two lateral surfaces of the solid electrolyte layer 51 becomes large. For this reason, if setting the sensor applied voltage Vr to a suitable value, between the two lateral surfaces of the solid electrolyte layer 51, the actual oxygen concentration ratio will become larger than the oxygen concentration ratio corresponding to the sensor applied voltage Vr. Therefore, as shown in FIG. 5(B), oxygen ions move from the atmosphere side electrode 53 toward the exhaust side electrode 52 so that the oxygen concentration ratio between the two lateral surfaces of the solid electrolyte layer 51 becomes smaller toward the oxygen concentration ratio corresponding to the sensor applied voltage Vr. As a result, current flows from the atmosphere side electrode 53, through the voltage application device 60 which applies the sensor applied voltage Vr, to the exhaust side electrode 52.

The magnitude of the current (output current) Ir flowing at this time is determined by the flow rate of oxygen ions which move through the solid electrolyte layer 51 from the atmosphere side electrode 53 to the exhaust side electrode 52, if setting the sensor applied voltage Vr to a suitable value. The oxygen ions react (burn) with the unburned gas, which diffuses from the exhaust through the diffusion regulating layer 54 to the measured gas chamber 57, on the exhaust side electrode 52. Accordingly, the flow rate in movement of the oxygen ions corresponds to the concentration of unburned gas in the exhaust gas flowing into the measured gas chamber 57. Therefore, by detecting the magnitude of this current Ir by the current detection device 61, it is possible to learn the concentration of unburned gas and in turn possible to learn the air-fuel ratio in the rich region.

Further, when the exhaust air-fuel ratio around the air-fuel ratio sensors 40, 41 is the stoichiometric air-fuel ratio, the amounts of oxygen and unburned gas which flow into the measured gas chamber 57 become a chemical equivalent ratio. Therefore, due to the catalytic action of the exhaust side electrode 52, oxygen and unburned gas completely burn and no fluctuation arises in the concentrations of oxygen and unburned gas in the measured gas chamber 57. As a result, the oxygen concentration ratio across the two lateral surfaces of the solid electrolyte layer 51 does not fluctuate, but is maintained at the oxygen concentration ratio corresponding to the sensor applied voltage Vr. For this reason, as shown in FIG. 5(C), no movement of oxygen ions occurs due to the oxygen pump characteristic. As a result, no current flows through the circuits.

Figure 6:
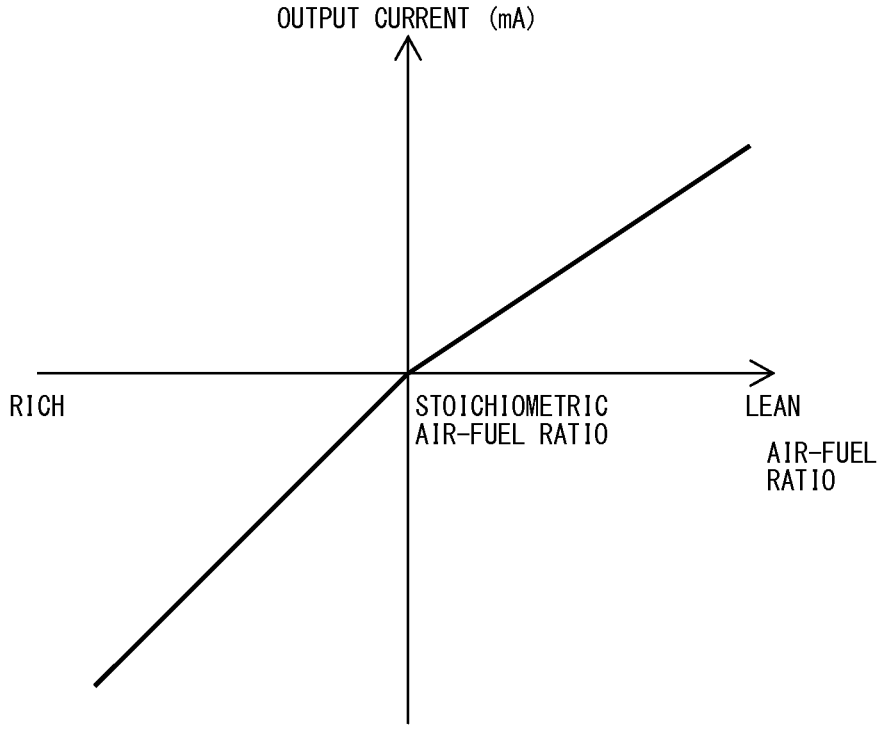
FIG. 6 shows the relationship between the sensor applied voltage and the output current in the downstream side air-fuel ratio sensor.

The air-fuel ratio sensors 40 and 41 configured and operating as above have the output characteristics which are shown in FIG. 6. That is, in the air-fuel ratio sensors 40 and 41, the larger the exhaust air-fuel ratio (that is, the leaner), the larger output currents Ir of the air-fuel ratio sensor 40 and 41 become. In addition, the air-fuel ratio sensors 40 and 41 are configured so that the output currents Ir become zero when the exhaust air-fuel ratio is the stoichiometric air-fuel ratio.

<Circuits of Voltage Application Device and Current Detection Device>

Figure 7:
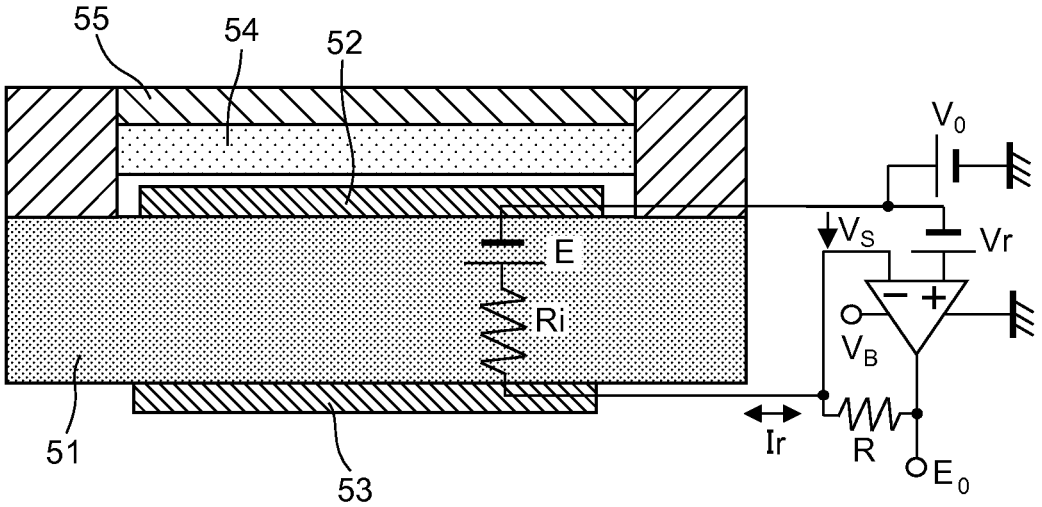
FIG. 7 is a view which shows an example of a specific circuit which forms a voltage application device and current detection device.

FIG. 7 shows an example of the specific circuits which form the voltage application device 60 and current detection device 61. In the illustrated example, the electromotive force E which occurs due to the oxygen cell characteristic is expressed as "E", the internal resistance of the solid electrolyte layer 51 is expressed as "Ri", and the difference of electrical potential across the two electrodes 52, 53 is expressed as "Vs".

As will be understood from FIG. 7, the voltage application device 60 basically performs negative feedback control so that the electromotive force E which occurs due to the oxygen cell characteristic matches the sensor applied voltage Vr. In other words, the voltage application device 60 performs negative feedback control so that even when a change in the oxygen concentration ratio between the two lateral surfaces of the solid electrode layer 51 causes the potential difference Vs between the two electrodes 52 and 53 to change, this potential difference Vs becomes the sensor applied voltage Vr.

Therefore, when the exhaust air-fuel ratio becomes the stoichiometric air-fuel ratio and no change occurs in the oxygen concentration ratio between the two lateral surfaces of the solid electrolyte layer 51, the oxygen concentration ratio between the two lateral surfaces of the solid electrolyte layer 51 becomes the oxygen concentration ratio corresponding to the sensor applied voltage Vr. In this case, the electromotive force E conforms to the sensor applied voltage Vr, the potential difference Vs between the two electrodes 52 and 53 also becomes the sensor applied voltage Vr, and, as a result, the current Ir does not flow.

On the other hand, when the exhaust air-fuel ratio becomes an air-fuel ratio which is different from the stoichiometric air-fuel ratio and a change occurs in the oxygen concentration ratio between the two lateral surfaces of the solid electrolyte layer 51, the oxygen concentration ratio between the two lateral surfaces of the solid electrolyte layer 51 does not become an oxygen concentration ratio corresponding to the sensor applied voltage Vr. In this case, the electromotive force E becomes a value different from the sensor applied voltage Vr. Therefore, due to negative feedback control, a potential difference Vs is applied between the two electrodes 52 and 53 so that oxygen ions move between the two lateral surfaces of the solid electrolyte layer 51 so that the electromotive force E conforms to the sensor applied voltage Vr. Further, current Ir flows along with movement of oxygen ions at this time. As a result, the electromotive force E converges to the sensor applied voltage Vr. If the electromotive force E converges to the sensor applied voltage Vr, finally the potential difference Vs also converges to the sensor applied voltage Vr.

Therefore, the voltage application device 60 can be said to substantially apply the sensor applied voltage Vr between the two electrodes 52 and 53. Note that, the electrical circuit of the voltage application device 60 does not have to be one such as shown in FIG. 7. The circuit may be any form of device so long as able to substantially apply the sensor applied voltage Vr across the two electrodes 52, 53.

Further, the current detection device 61 does not actually detect the current. It detects the voltage $E_0$ to calculate the current from this voltage $E_0$. In this regard, $E_0$ is expressed as in the following equation (1).

$$E_0 = Vr + V_0 + I_r R \tag{1}$$

wherein, $V_0$ is the offset voltage (voltage applied so that $E_0$ does not become a negative value, for example, 3V), while R is the value of the resistance shown in FIG. 7.

In equation (1), the sensor applied voltage Vr, offset voltage $V_0$, and resistance value R are constant, and therefore the voltage $E_0$ changes in accordance with the current Ir. For this reason, if detecting the voltage $E_0$, it is possible to calculate the current Ir from that voltage $E_0$.

Therefore, the current detection device 61 can be said to substantially detect the current Ir which flows across the two electrodes 52, 53. Note that, the electrical circuit of the current detection device 61 does not have to be one such as shown in FIG. 7. If possible to detect the current Ir flowing across the two electrodes 52, 53, any form of device may be used.

<Summary of Air-Fuel Ratio Control>

Next, a summary of the air-fuel ratio control in the control system of the present invention of internal combustion engine will be explained. In the present embodiment, feedback control is performed, based on the output current Irup of the upstream side air-fuel ratio sensor 40, so that the output current Irup of the upstream side air-fuel ratio sensor 40 (that is, corresponding to air-fuel ratio of exhaust gas flowing into the upstream side exhaust purification catalyst 20) becomes a value corresponding to the target air-fuel ratio.

In the present embodiment, the target air-fuel ratio of the exhaust gas flowing into the upstream side exhaust purification catalyst 20 is set based on the output current Irdwn of the downstream side air-fuel ratio sensor 41 and the oxygen storage amount OSAsc of the upstream side exhaust purification catalyst 20. Specifically, when the output current Irdwn of the downstream side air-fuel ratio sensor 41 becomes the rich judgment reference value Irrich or less, it is judged that the air-fuel ratio of the exhaust gas which was detected by the downstream side air-fuel ratio sensor 41 has become the rich air-fuel ratio. In this case, due to the lean switching means, the target air-fuel ratio is set to the lean set air-fuel ratio and is maintained at that air-fuel ratio. In this regard, the rich judgment reference value Irrich is a value which corresponds to a predetermined rich judgement air-fuel ratio (for example, 14.55) which is slightly richer than the stoichiometric air-fuel ratio. Further, the lean set air-fuel ratio is a predetermined air-fuel ratio which is leaner by a certain extent from the stoichiometric air-fuel ratio, and, for example, is 14.65 to 20, preferably 14.68 to 18, more preferably 14.7 to 16 or so.

Then, when, in the state where the target air-fuel ratio is set to the lean set air-fuel ratio, the oxygen storage amount OSAsc of the upstream side exhaust purification catalyst 20 reaches a given storage amount larger than zero, the target air-fuel ratio is switched to a slight lean set air-fuel ratio by the lean degree lowering means (note that, the oxygen storage amount at this time will be referred to as the "lean degree change reference storage amount"). The "slight lean set air-fuel ratio" is a lean air-fuel ratio which has a smaller difference from the stoichiometric air-fuel ratio than the lean set air-fuel ratio, and, for example, is 14.62 to 15.7, preferably 14.63 to 15.2, more preferably 14.65 to 14.9 or so. Further, the lean degree change reference storage amount is a storage amount which has a difference from zero which is a given reference difference of change $\alpha$.

On the other hand, when the output current Irdwn of the downstream side air-fuel ratio sensor 41 becomes a lean judgment reference value Irlean or more, it is judged that the air-fuel ratio of the exhaust gas which is detected by the downstream side air-fuel ratio sensor 41 becomes the lean air-fuel ratio. In this case, due to the rich switching means, the target air-fuel ratio is set to the rich set air-fuel ratio and is maintained at that air-fuel ratio. In this regard, the lean judgment reference value Irlean is a value which corresponds to a predetermined lean judgement air-fuel ratio (for example, 14.65) which is slightly leaner than the stoichiometric air-fuel ratio. Further, the rich set air-fuel ratio is a predetermined air-fuel ratio which is a richer by a certain extent from the stoichiometric air-fuel ratio, and, for example, is 10 to 14.55, preferably 12 to 14.52, more preferably 13 to 14.5 or so.

Then, when, in the state where the target air-fuel ratio is set to the rich set air-fuel ratio, the oxygen storage amount OSAsc of the upstream side exhaust purification catalyst 20 reaches a given storage amount smaller than the maximum storage amount, the target air-fuel ratio is switched to the slight rich set air-fuel ratio by the rich degree lowering means (note that, the oxygen storage amount at this time will be referred to as the "rich degree change reference storage amount"). The slight rich set air-fuel ratio is a rich air-fuel ratio which has a smaller difference from the stoichiometric air-fuel ratio than the rich set air-fuel ratio, and, for example, is 13.5 to 14.58, preferably 14 to 14.57, more preferably 14.3 to 14.55 or so. Further, the rich degree change reference storage amount is a storage amount which is a difference from the maximum oxygen storage amount which is the given reference difference of change $\alpha$.

As a result, in the present embodiment, if the output current Irdwn of the downstream side air-fuel ratio sensor 41 becomes the rich judgment reference value Irrich or less, first, the target air-fuel ratio is set to the lean set air-fuel ratio. Then, if the oxygen storage amount OSAsc becomes larger by a certain extent, it is set to a slight lean set air-fuel ratio. After that, if the output current Irdwn of the downstream side air-fuel ratio sensor 41 becomes the lean judgment reference value Irlean or more, first, the target air-fuel ratio is set to a rich set air-fuel ratio. Then, if the oxygen storage amount OSAsc becomes smaller by a certain extent, it is set to a slight rich set air-fuel ratio, then a similar operation is repeated.

Note that, the rich judgement air-fuel ratio and the lean judgement air-fuel ratio are set to air-fuel ratios within 1% of the stoichiometric air-fuel ratio, preferably within 0.5% thereof, more preferably within 0.35% thereof. Therefore, the differences of the rich judgement air-fuel ratio and lean judgement air-fuel ratio from the stoichiometric air-fuel ratio are, when the stoichiometric air-fuel ratio is 14.6, 0.15 or less, preferably 0.073 or less, more preferably 0.051 or less. Further, the difference of the target air-fuel ratio (for example, slight rich set air-fuel ratio or lean set air-fuel ratio) from the stoichiometric air-fuel ratio is set so as to be larger than the reference difference.

Further, in the present embodiment, the oxygen storage amount OSAsc of the upstream side exhaust purification catalyst 20 is estimated by the oxygen storage amount estimating means. By the inflowing unburned gas excess/deficient flow amount calculating means, the oxygen storage amount estimating means calculate, based on the air-fuel ratio detected by the upstream side air-fuel ratio sensor 40 and amount of intake air of the internal combustion engine which is calculated based on the output value of the air flow meter 39, etc., the amount of flow of unburned gas which becomes excess or unburned gas which becomes deficient when trying to make the air-fuel ratio of the exhaust gas flowing into the upstream side exhaust purification catalyst 20 the stoichiometric air-fuel ratio (below, referred to as "inflowing unburned gas excess/deficient flow amount $\Delta$Qcor").

That is, the inflowing unburned gas excess/deficient flow amount calculating means calculates the amount of flow of unburned gas which is contained in the exhaust gas or the amount of flow of unburned gas which is required for burning the oxygen which is contained in the exhaust gas, when assuming that the oxygen and unburned gas, etc., in the exhaust gas flowing into the upstream side exhaust purification catalyst 20 completely reacts. Specifically, the inflowing unburned gas excess/deficient flow amount calculating means calculates the inflowing unburned gas excess/deficient flow amount $\Delta$Qcor, based on the intake air amount of the internal combustion engine which was calculated based on the air flow meter 39, etc., and the difference of the air-fuel ratio which was detected by the upstream side air-fuel ratio sensor 40 from the stoichiometric air-fuel ratio.

Similarly, by the outflowing unburned gas excess/deficient flow amount calculating means, the oxygen storage amount estimating means calculate, based on the air-fuel ratio detected by the downstream side air-fuel ratio sensor 41 and the intake air amount of the internal combustion engine which was calculated based on the output of the air flow meter 39, etc., the flow amount of unburned gas which becomes excessive or unburned gas which becomes deficient when trying to make the air-fuel ratio of the exhaust gas flowing out from the upstream side exhaust purification catalyst 20 the stoichiometric air-fuel ratio (below, referred to as the "outflowing unburned gas excess/deficient flow amount $\Delta$Qsc").

That is, the outflowing unburned gas excess/deficient flow amount calculating means calculates the amount of flow of unburned gas which is contained in the exhaust gas or the amount of flow of unburned gas which is necessary for burning the oxygen which is contained in the exhaust gas, when assuming that the oxygen and unburned gas, etc., in the exhaust gas flowing out from the upstream side exhaust purification catalyst 20 completely react. Specifically, the outflowing unburned gas excess/deficient flow amount calculating means calculates the outflowing unburned gas excess/deficient flow amount $\Delta$Qsc, based on the intake air amount of the internal combustion engine which is calculated based on the air flow meter 39, etc., and the difference of the air-fuel ratio which was detected by the downstream side air-fuel ratio sensor 41 from the stoichiometric air-fuel ratio.

In addition, the oxygen storage amount estimating means calculates the oxygen storage amount OSAsc of the upstream side exhaust purification catalyst 20, by the storage amount calculating means, based on the cumulative value ΣQsc of flow amount difference (=Σ(ΔQcor−ΔQsc)) obtained by cumulatively adding the flow amount difference (ΔQcor−ΔQsc) obtained by subtracting the outflowing unburned gas excess/deficient flow amount ΔQsc from the inflowing unburned gas excess/deficient flow amount ΔQcor. In this regard, the flow amount difference corresponds to the amount of flow of unburned gas which was burned and removed at the upstream side exhaust purification catalyst 20 or the amount of flow of oxygen which was stored at the upstream side exhaust purification catalyst 20. Therefore, the cumulative value ΣQsc of flow amount difference is proportional to the oxygen storage amount OSAsc of the upstream side exhaust purification catalyst 20, and therefore it is possible to accurately estimate the oxygen storage amount based on the cumulative value ΣQsc of flow amount difference.

Note that, the above-mentioned oxygen storage amount estimating means estimates the oxygen storage amount OSAsc of the upstream side exhaust purification catalyst 20, based on the excess/deficient flow amount of the unburned gas in the exhaust gas flowing into the upstream side exhaust purification catalyst 20 or in the exhaust gas flowing out from the upstream side exhaust purification catalyst 20. However, it is also possible to estimate the oxygen storage amount OSAsc of the upstream side exhaust purification catalyst 20 based on the excess/deficient flow amount of the oxygen in the exhaust gas flowing into the upstream side exhaust purification catalyst 20 or in the exhaust gas flowing out from the upstream side exhaust purification catalyst 20. In this case, the oxygen excess/deficient flow amount is calculated by multiplying the amount of fuel which is fed from a fuel injector 11 to a combustion chamber 5 with a difference between the air-fuel ratio detected by the air-fuel ratio sensors 40, 41 and the stoichiometric air-fuel ratio.

Note that, the above-mentioned target air-fuel ratio is set and the oxygen storage amount is estimated by the ECU 31. Therefore, the ECU 31 can be said to have an air-fuel ratio lean switching means, lean degree lowering means, air-fuel ratio rich switching means, rich degree lowering means, inflowing unburned gas excess/deficient flow amount calculating means, outflowing unburned gas excess/deficient flow amount calculating means, and storage amount calculating means.

<Explanation of Control Using Time Chart>

Figure 8:
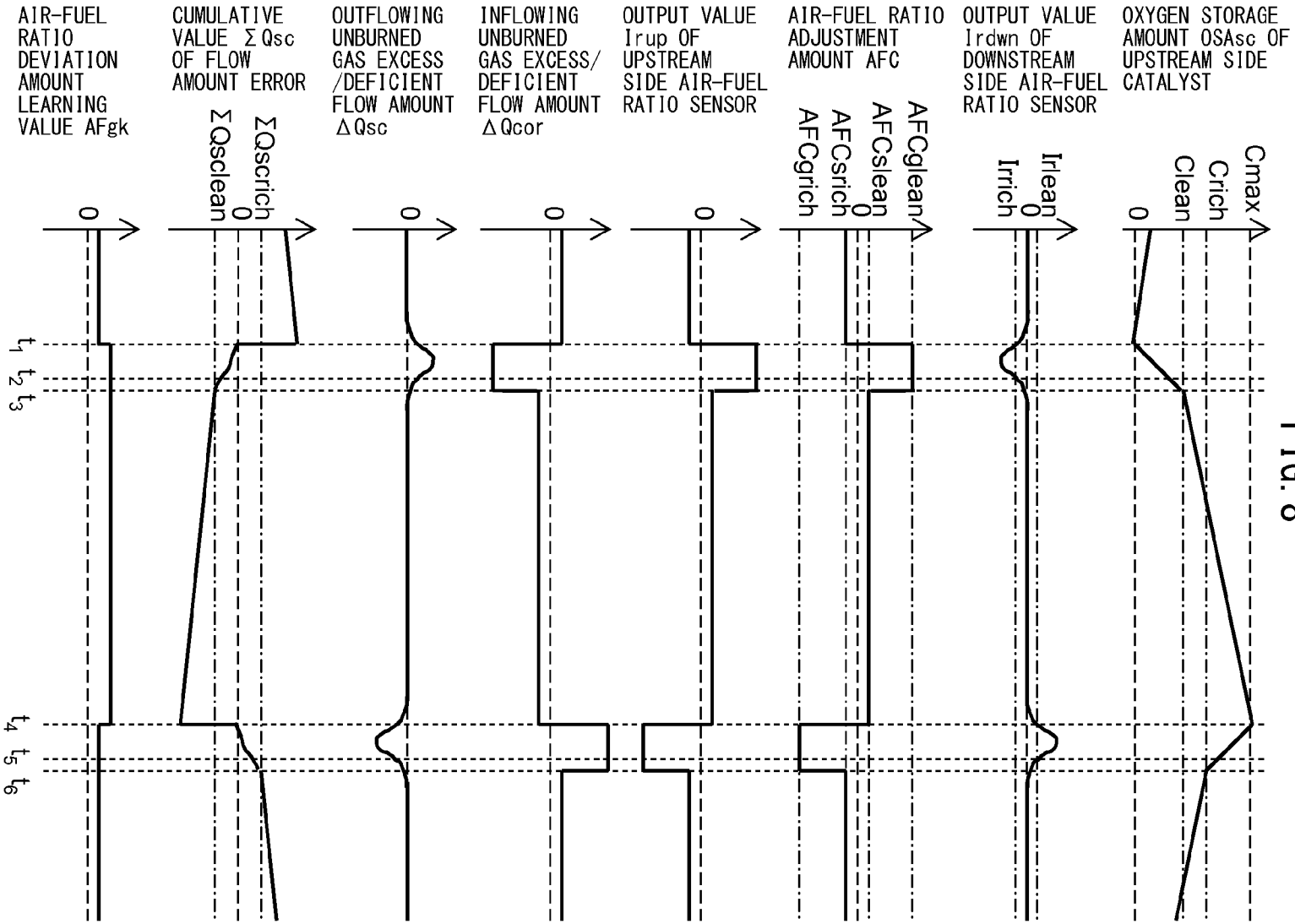
FIG. 8 is a time chart of the oxygen storage amount of the upstream side exhaust purification catalyst, etc.

Referring to FIG. 8, the above-mentioned operation will be specifically explained. FIG. 8 is a time chart of the oxygen storage amount OSAsc of the upstream side exhaust purification catalyst 20, output current Irdwn of the downstream side air-fuel ratio sensor 41, air-fuel ratio adjustment amount AFC, output current Irup of the upstream side air-fuel ratio sensor 40, inflowing unburned gas excess/deficient flow amount ΔQcor, outflowing unburned gas excess/deficient flow amount ΔQsc, cumulative value ΣQsc of flow amount difference, and learning value gk of air-fuel ratio deviation, in the case of performing air-fuel ratio control in a control system of an internal combustion engine according to the present embodiment.

Note that, as explained above, the output current Irup of the upstream side air-fuel ratio sensor 40 becomes zero when the air-fuel ratio of the exhaust gas flowing into the upstream side exhaust purification catalyst 20 is the stoichiometric air-fuel ratio, becomes a negative value when the air-fuel ratio of the exhaust gas is a rich air-fuel ratio, and becomes a positive value when the air-fuel ratio of the exhaust gas is a lean air-fuel ratio. Further, when the air-fuel ratio of the exhaust gas flowing into the upstream side exhaust purification catalyst 20 is a rich air-fuel ratio or lean air-fuel ratio, the larger the difference from the stoichiometric air-fuel ratio, the larger the absolute value of the output current Irup of the upstream side air-fuel ratio sensor 40 becomes.

The output current Irdwn of the downstream side air-fuel ratio sensor 41 also changes in accordance with the air-fuel ratio of the exhaust gas flowing out from the upstream side exhaust purification catalyst 20 in the same way as the output current Irup of the upstream side air-fuel ratio sensor 40. Further, the air-fuel ratio adjustment amount AFC is a adjustment amount relating to the target air-fuel ratio. When the air-fuel ratio adjustment amount AFC is 0, the target air-fuel ratio is set to the stoichiometric air-fuel ratio, when the air-fuel ratio adjustment amount AFC is a positive value, the target air-fuel ratio is a lean air-fuel ratio, and when the air-fuel ratio adjustment amount AFC is a negative value, the target air-fuel ratio is a rich air-fuel ratio.

Further, the learning value AFgk of the air-fuel ratio deviation is used for correction of deviation when the air-fuel ratio of the exhaust gas which actually flows into the upstream side exhaust purification catalyst 20 deviates from the target air-fuel ratio of the exhaust gas flowing into the upstream side exhaust purification catalyst 20. Specifically, when the actual exhaust air-fuel ratio deviates from the target air-fuel ratio, the learning value of the air-fuel ratio deviation AFgk is updated in accordance with this amount of deviation. The next and later target air-fuel ratios are set in consideration of the updated learning value AFgk of the air-fuel ratio deviation.

In the illustrated example, in the state before the time $t_1$, the air-fuel ratio adjustment amount AFC of the target air-fuel ratio is set to a slight rich set adjustment amount AFCsrich. A "slight rich set adjustment amount AFCsrich" is a value corresponding to a slight rich set air-fuel ratio and a value smaller than 0. Therefore, the target air-fuel ratio of the exhaust gas flowing into the upstream side exhaust purification catalyst 20 is set to a rich air-fuel ratio. Along with this, the output current Irup of the upstream side air-fuel ratio sensor 40 is a negative value. The exhaust gas flowing into the upstream side exhaust purification catalyst 20 contains unburned gas, and therefore the oxygen storage amount OSAsc of the upstream side exhaust purification catalyst 20 gradually decreases. However, the unburned gas contained in the exhaust gas is purified by the upstream side exhaust purification catalyst 20, and therefore the output current Irdwn of the downstream side air-fuel ratio sensor is substantially 0 (corresponding to stoichiometric air-fuel ratio). Further, the exhaust gas flowing into the upstream side exhaust purification catalyst 20 also contains unburned gas, though the amount of which is slight, and therefore the inflowing unburned gas excess/deficient flow amount ΔQcor is a positive value, that is, is in a state where unburned gas is excess.

On the other hand, the unburned gas in the exhaust gas flowing into the upstream side exhaust purification catalyst 20 is oxidized and purified by the oxygen which is stored in the upstream side exhaust purification catalyst 20. Therefore, not only the amount of exhaust of oxygen (and $NO_X$) from the upstream side exhaust purification catalyst 20, but also the amount of exhaust of unburned gas is suppressed. Therefore, the outflowing unburned gas excess/deficient flow amount ΔQsc is substantially zero. As a result, the cumulative value ΣQsc of flow amount difference gradually increases. This shows that the oxygen storage amount OSAsc of the upstream side exhaust purification catalyst 20 is gradually decreasing.

In addition, in the illustrated example, before the time $t_1$, the learning value of the air-fuel ratio deviation AFgk is a positive value. Therefore, in the illustrated example, before the time $t_1$, the value of the air-fuel ratio adjustment amount AFC deviated to the lean side (AFC+AFgk) is set as the target air-fuel ratio.

Figure 2:
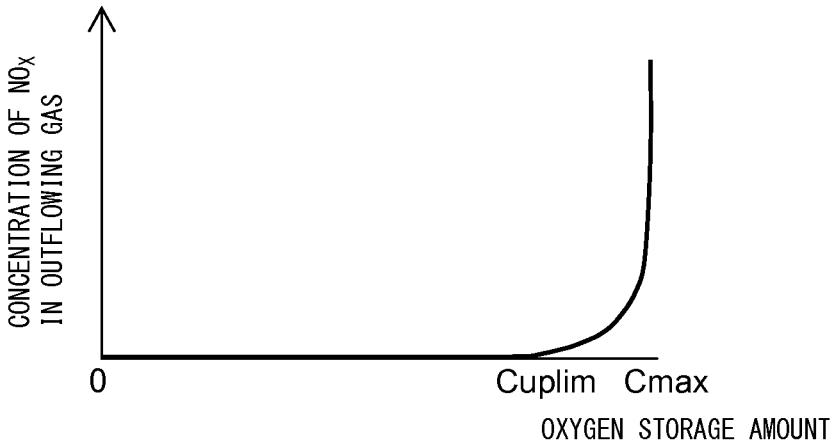
FIG. 2 is a view which shows the relationship between the oxygen storage amount of an exhaust purification catalyst and flow rate of $NO_X$ or unburned gas.
Figure 2:
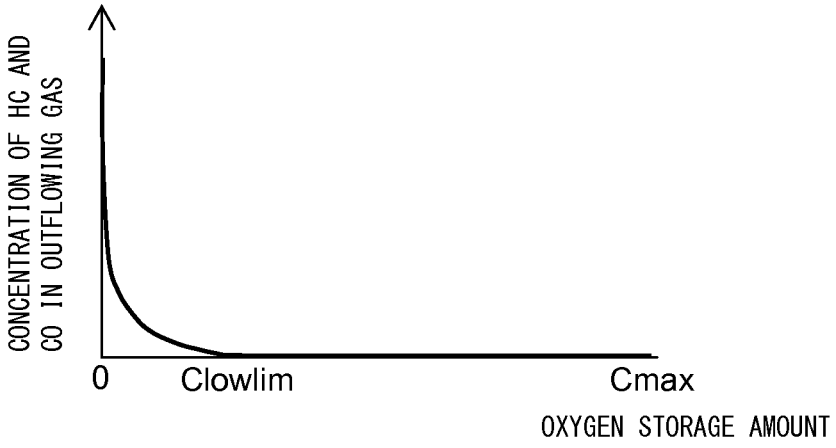

If the oxygen storage amount OSAsc of the upstream side exhaust purification catalyst 20 gradually decreases, the oxygen storage amount OSAsc decreases beyond the lower limit storage amount (see FIG. 2, Clowlim). If the oxygen storage amount OSAsc decreases from the lower limit storage amount, part of the unburned gas flowing into the upstream side exhaust purification catalyst 20 flows out without being purified by the upstream side exhaust purification catalyst 20.

Therefore, right before the time $t_1$ of FIG. 8, along with decreasing in the oxygen storage amount OSAsc of the upstream side exhaust purification catalyst 20 decreases, the output current Irdwn of the downstream side air-fuel ratio sensor 41 gradually falls. Note that, the unburned gas contained in the exhaust gas flowing out from the upstream side exhaust purification catalyst 20 is oxidized and purified by the downstream side exhaust purification catalyst 24.

If the exhaust gas flowing out from the upstream side exhaust purification catalyst 20 contains unburned gas in this way and the output current Irdwn of the downstream side air-fuel ratio sensor 41 gradually falls, the outflowing unburned gas excess/deficient flow amount ΔQsc which is calculated based on the output current Irdwn of the downstream side air-fuel ratio sensor 41 increases. However, the flow amount of the unburned gas in the exhaust gas flowing out from the upstream side exhaust purification catalyst 20 is small, and therefore the outflowing unburned gas excess/deficient flow amount ΔQsc is smaller in absolute value than the inflowing unburned gas excess/deficient flow amount ΔQcor. Accordingly, at this time as well, the cumulative value ΣQsc of flow amount difference gradually increases. This shows that at this time as well, the oxygen storage amount OSAsc of the upstream side exhaust purification catalyst 20 gradually decreases.

Then, the output current Irdwn of the downstream side air-fuel ratio sensor 41 gradually falls and, at the time $t_1$, reaches the rich judgment reference value Irrich which corresponds to the rich judgement air-fuel ratio. In the present embodiment, if the output current Irdwn of the downstream side air-fuel ratio sensor 41 becomes the rich judgment reference value Irrich or less, in order to suppress the decrease of the oxygen storage amount OSAsc of the upstream side exhaust purification catalyst 20, the air-fuel ratio adjustment amount AFC is switched to the lean set adjustment amount AFCglean. The lean set adjustment amount AFCglean is a value which corresponds to the lean set air-fuel ratio and is a value larger than 0.

Note that, in the present embodiment, after the output current Irdwn of the downstream side air-fuel ratio sensor 41 reaches the rich judgment reference value Irrich, that is, after the air-fuel ratio of the exhaust gas flowing out from the upstream side exhaust purification catalyst 20 reaches the rich judgement air-fuel ratio, the air-fuel ratio adjustment amount AFC is switched. This is because even if the oxygen storage amount of the upstream side exhaust purification catalyst 20 is sufficient, the air-fuel ratio of the exhaust gas flowing out from the upstream side exhaust purification catalyst 20 sometimes deviates very slightly from the stoichiometric air-fuel ratio. That is, if it is judged that the oxygen storage amount of the upstream side exhaust purification catalyst 20 has decreased beyond the lower limit storage amount when the output current Irdwn deviates slightly from a value corresponding to the stoichiometric air-fuel ratio (that is, zero), there is a possibility of the oxygen storage amount OSAsc being judged to have decreased beyond the lower limit storage amount even if there is actually a sufficient oxygen storage amount. Therefore, in the present embodiment, it is not until the air-fuel ratio of the exhaust gas flowing out from the upstream side exhaust purification catalyst 20 reaches the rich judgement air-fuel ratio, that it is judged that the oxygen storage amount has decreased beyond the lower limit storage amount. Conversely speaking, the rich judgement air-fuel ratio is set to an air-fuel ratio which the air-fuel ratio of the exhaust gas flowing out from the upstream side exhaust purification catalyst 20 does not reach much at all when the oxygen storage amount of the upstream side exhaust purification catalyst 20 is sufficient. Note that, the same can be said for the later explained lean judgement air-fuel ratio.

If, at the time $t_1$, the target air-fuel ratio of the exhaust gas flowing into the upstream side exhaust purification catalyst 20 is switched to the lean set air-fuel ratio, the air-fuel ratio of the exhaust gas flowing into the upstream side exhaust purification catalyst 20 also changes from the rich air-fuel ratio to the lean air-fuel ratio (in actual, a delay occurs from when the target air-fuel ratio is switched to when the air-fuel ratio of the exhaust gas flowing into the upstream side exhaust purification catalyst 20 changes, but, in the illustrated example, they are assumed for convenience to simultaneously change).

If, at the time $t_1$, the air-fuel ratio of the exhaust gas flowing into the upstream side exhaust purification catalyst 20 changes to the lean air-fuel ratio, the output current Irup of the upstream side air-fuel ratio sensor 40 becomes a positive value, and the oxygen storage amount OSAsc of the upstream side exhaust purification catalyst 20 starts to increase. Further, the exhaust gas flowing into the upstream side exhaust purification catalyst 20 contains a large amount of oxygen, therefore the inflowing unburned gas excess/deficient flow amount ΔQcor becomes a negative value, that is, in a state where unburned gas is deficient.

Note that, in the illustrated example, right after switching the target air-fuel ratio, the output current Irdwn of the downstream side air-fuel ratio sensor 41 falls. This is because a delay occurs from when switching the target air-fuel ratio to when the exhaust gas reaches the upstream side exhaust purification catalyst 20, and thus unburned gas continues to flow out from the upstream side exhaust purification catalyst 20. Therefore, the outflowing unburned gas excess/deficient flow amount ΔQsc which is calculated based on the output current Irdwn of the downstream side air-fuel ratio sensor 41 becomes a positive value. However, the amount of flow of unburned gas in the exhaust gas flowing out from the upstream side exhaust purification catalyst 20 is small, and therefore the absolute value of the outflowing unburned gas excess/deficient flow amount ΔQsc is smaller than the absolute value of the inflowing unburned gas excess/deficient flow amount ΔQcor. Accordingly, after the time $t_2$, the cumulative value ΣQsc of flow amount difference gradually decreases. This shows that, at this time, the oxygen storage amount OSAsc of the upstream side exhaust purification catalyst 20 is gradually increasing.

Further, the cumulative value ΣQsc of flow amount difference is reset to zero at the time $t_1$. This is because, in the present embodiment, the cumulative value ΣQsc of flow amount difference is calculated from a reference timing, such as when the target air-fuel ratio is switched from the rich air-fuel ratio to the lean air-fuel ratio or when it is switched from the lean air-fuel ratio to the rich air-fuel ratio. At the same time, at the time $t_1$, the learning value of the air-fuel ratio deviation AFgk is updated. At this time, the learning value of the air-fuel ratio deviation AFgk is updated based on the following formula (2) by multiplying the given coefficient C with the cumulative value ΣQsc of flow amount difference right before the time $t_1$ and adding the product to the value up to then (note that, "i" in formula (2) indicates the number of updates).

$$AFgk(i)=AFgk(i-1)+C\cdot\Sigma Qsc \quad (2)$$

Then, along with an increase of the oxygen storage amount OSAsc of the upstream side exhaust purification catalyst 20, the air-fuel ratio of the exhaust gas flowing out from the upstream side exhaust purification catalyst 20 changes to the stoichiometric air-fuel ratio and the output current Irdwn of the downstream side air-fuel ratio sensor 41 converges to 0. Therefore, the output current Irdwn of the downstream side air-fuel ratio sensor 41 becomes the rich judgment reference value Irrich or more at the time $t_2$ on. During this period as well, the air-fuel ratio adjustment amount AFC of the target air-fuel ratio is maintained at the lean set adjustment amount AFCglean, and thus the output current Irup of the upstream side air-fuel ratio sensor 40 is maintained at a positive value.

If the oxygen storage amount OSAsc of the upstream side exhaust purification catalyst 20 continues increasing, at the time $t_3$, it riches the lean degree change reference storage amount Clean. At this time, the cumulative value ΣQsc of flow amount difference reaches the reference cumulative value ΣQsclean of lean degree change. In the present embodiment, if the cumulative value ΣQsc of flow amount difference becomes the reference cumulative value ΣQsclean of lean degree change or less, in order to slow the speed of increase of the oxygen storage amount OSAsc of the upstream side exhaust purification catalyst 20, the air-fuel ratio adjustment amount AFC is switched to the slight lean set adjustment amount AFCslean. The slight lean set adjustment amount AFCslean is a value which corresponds to the slight lean set air-fuel ratio, and is a value which is smaller than AFCglean and larger than 0.

If, at the time $t_3$, the target air-fuel ratio is switched to the slight lean set air-fuel ratio, the difference between the air-fuel ratio of the exhaust gas flowing into the upstream side exhaust purification catalyst 20 and the stoichiometric air-fuel ratio also becomes smaller. Along with this, the value of the output current Irup of the upstream side air-fuel ratio sensor 40 becomes smaller, and the increase speed of the oxygen storage amount OSAsc of the upstream side exhaust purification catalyst 20 falls. In addition, the amount of oxygen which is contained in the exhaust gas flowing into the upstream side exhaust purification catalyst 20 decreases, and therefore the absolute value of the inflowing unburned gas excess/deficient flow amount ΔQcor falls.

On the other hand, the oxygen in the exhaust gas flowing into the upstream side exhaust purification catalyst 20 is stored at the upstream side exhaust purification catalyst 20. Therefore, not only the amount of exhaust of unburned gas from the upstream side exhaust purification catalyst 20, but also the amount of exhaust of oxygen therefrom is suppressed. Therefore, the outflowing unburned gas excess/deficient flow amount ΔQsc becomes substantially zero. As a result, the cumulative value ΣQsc of flow amount difference gradually decreases. This shows that the oxygen storage amount OSAsc of the upstream side exhaust purification catalyst 20 gradually increases. Note that, at this time, the $NO_X$ in the exhaust gas flowing into the upstream side exhaust purification catalyst 20 is reduced and purified at the upstream side exhaust purification catalyst 20, and therefore the amount of exhaust of $NO_X$ from the upstream side exhaust purification catalyst 20 is also suppressed.

After the time $t_3$, the oxygen storage amount OSAsc of the upstream side exhaust purification catalyst 20 gradually increases, though the speed of increase is slow. If the oxygen storage amount OSAsc of the upstream side exhaust purification catalyst 20 gradually increases, the oxygen storage amount OSAsc increases beyond the upper limit storage amount (see Cuplim of FIG. 2). If the oxygen storage amount OSAsc increases beyond the upper limit storage amount, part of the oxygen flowing into the upstream side exhaust purification catalyst 20 flows out without being stored at the upstream side exhaust purification catalyst 20. Therefore, right before the time $t_4$ of FIG. 8, along with an increase of the oxygen storage amount OSAsc of the upstream side exhaust purification catalyst 20, the output current Irdwn of the downstream side air-fuel ratio sensor 41 gradually rises. Note that, along with the upstream side exhaust purification catalyst 20 becoming unable to store part of the oxygen, $NO_X$ also can no longer be reduced and purified, but this $NO_X$ is reduced and purified by the downstream side exhaust purification catalyst 24.

If, in this way, the exhaust gas flowing out from the upstream side exhaust purification catalyst 20 contains oxygen and the output current Irdwn of the downstream side air-fuel ratio sensor 41 gradually rises, the outflowing unburned gas excess/deficient flow amount ΔQsc which is calculated based on the output current Irdwn of the downstream side air-fuel ratio sensor 41 decreases. However, the amount of flow of the oxygen in the exhaust gas flowing out from the upstream side exhaust purification catalyst 20 is small, and therefore the outflowing unburned gas excess/deficient flow amount ΔQsc is smaller in absolute value than the inflowing unburned gas excess/deficient flow amount ΔQcor and, accordingly, at this time as well, the cumulative value ΣQsc of flow amount difference gradually decreases. This shows that at this time as well, the oxygen storage amount OSAsc of the upstream side exhaust purification catalyst 20 gradually increases.

Then, the output current Irdwn of the downstream side air-fuel ratio sensor 41 gradually rises, and, at the time $t_4$, reaches the lean judgment reference value Irlean which corresponds to the lean judgement air-fuel ratio. In the present embodiment, if the output current of the downstream side air-fuel ratio sensor 41 becomes the lean judgment reference value Irlean or more, in order to suppress an increase of the oxygen storage amount OSAsc of the upstream side exhaust purification catalyst 20, the air-fuel ratio adjustment amount AFC is switched to the rich set adjustment amount AFCgrich. The rich set adjustment amount AFCgrich is a value corresponding to the rich set air-fuel ratio and is a value smaller than 0.

If, at the time $t_4$, switching the target air-fuel ratio of the exhaust gas flowing into the upstream side exhaust purification catalyst 20 to the rich set air-fuel ratio, the air-fuel ratio of the exhaust gas flowing into the upstream side exhaust purification catalyst 20 also changes from the lean air-fuel ratio to the rich air-fuel ratio (in actuality, a delay occurs from when the target air-fuel ratio is switched to when the air-fuel ratio of the exhaust gas flowing into the upstream side exhaust purification catalyst 20 changes, but, in the illustrated example, these are assumed to change simultaneously for convenience).

If, at the time $t_4$, the air-fuel ratio of the exhaust gas flowing into the upstream side exhaust purification catalyst 20 changes to the rich air-fuel ratio, the output current Irup of the upstream side air-fuel ratio sensor 40 becomes a negative value, and the oxygen storage amount OSAsc of the upstream side exhaust purification catalyst 20 starts to decrease. Further, the exhaust gas flowing into the upstream side exhaust purification catalyst 20 contains a large amount of unburned gas, and therefore the inflowing unburned gas excess/deficient flow amount ΔQcor becomes a positive value, that is, in a state where unburned gas is excess.

Note that, at the time $t_4$, the cumulative value ΣQsc of flow amount difference is reset to zero and, simultaneously, a learning value of the air-fuel ratio deviation AFgk is updated. At this time, the learning value of the air-fuel ratio deviation AFgk is updated based on the above formula (2) by multiplying the given coefficient C with the cumulative value ΣQsc of flow amount difference right before the time $t_4$ and adding the product to the value up to then.

Then, along with a decrease of the oxygen storage amount OSAsc of the upstream side exhaust purification catalyst 20, the air-fuel ratio of the exhaust gas flowing out from the upstream side exhaust purification catalyst 20 changes to the stoichiometric air-fuel ratio, and the output current Irdwn of the downstream side air-fuel ratio sensor 41 converges to "0". Therefore, the output current Irdwn of the downstream side air-fuel ratio sensor 41 becomes the lean judgment reference value Irlean or less, after the time $t_5$. During this period as well, the air-fuel ratio adjustment amount AFC of the target air-fuel ratio is maintained at the rich set adjustment amount AFCgrich, and the output current Irup of the upstream side air-fuel ratio sensor 40 is maintained at a negative value.

If the oxygen storage amount OSAsc of the upstream side exhaust purification catalyst 20 continues to decrease, at the time $t_6$, it reaches the rich degree change reference storage amount Crich. At this time, the cumulative value ΣQsc of flow amount difference reaches the reference cumulative value ΣQscrich of rich degree change. In the present embodiment, if the cumulative value ΣQsc of flow amount difference becomes the reference cumulative value ΣQscrich of rich degree change or more, in order to slow the speed of decrease of the oxygen storage amount OSAsc of the upstream side exhaust purification catalyst 20, the air-fuel ratio adjustment amount AFC is switched to the slight rich set adjustment amount AFCsrich. The slight rich set adjustment amount AFCsrich is a value corresponding go the slight rich set air-fuel ratio, and is a value which is larger than AFCgrich and smaller than 0.

At the time $t_6$, if switching the target air-fuel ratio to the slight rich set air-fuel ratio, the difference between the air-fuel ratio of the exhaust gas flowing into the upstream side exhaust purification catalyst 20 and the stoichiometric air-fuel ratio becomes smaller. Along with this, the value of the output current Irup of the upstream side air-fuel ratio sensor 40 becomes larger, and the speed of decrease of the oxygen storage amount OSAsc of the upstream side exhaust purification catalyst 20 falls. In addition, the amount of the unburned gas contained in the exhaust gas flowing into the upstream side exhaust purification catalyst 20 is decreased, and therefore the absolute value of the inflowing unburned gas excess/deficient flow amount ΔQcor falls.

On the other hand, the unburned gas in the exhaust gas flowing into the upstream side exhaust purification catalyst 20 is oxidized and purified at the upstream side exhaust purification catalyst 20. Therefore, not only the amount of exhaust of oxygen and $NO_X$ from the upstream side exhaust purification catalyst 20, but also the amount of exhaust of unburned gas therefrom is suppressed. Therefore, the outflowing unburned gas excess/deficient flow amount ΔQsc becomes substantially zero. As a result, the cumulative value ΣQsc of flow amount difference gradually increases. This shows that the oxygen storage amount OSAsc of the upstream side exhaust purification catalyst 20 is gradually decreasing.

After the time $t_5$, the oxygen storage amount OSAsc of the upstream side exhaust purification catalyst 20 gradually decreases, though the decrease speed thereof is slow. As a result, unburned gas starts to flow out from the upstream side exhaust purification catalyst 20. As a result, in the same way as the time $t_1$, the output current Irdwn of the downstream side air-fuel ratio sensor 41 reaches the rich judgment reference value Irrich. Then, a similar operation to the operation of the times $t_1$ to $t_6$ is repeated.

<Action and Effect in Control of Present Embodiment>

According to the air-fuel ratio control of the present embodiment explained above, right after the target air-fuel ratio is changed from the rich air-fuel ratio to the lean air-fuel ratio at the time $t_1$ and right after the target air-fuel ratio is changed from the lean air-fuel ratio to the rich air-fuel ratio at the time $t_4$, the difference of the target air-fuel ratio from the stoichiometric air-fuel ratio is set large (that is, the rich degree or lean degree is set large). Therefore, the unburned gas which flowed out from the upstream side exhaust purification catalyst 20 at the time $t_1$, and the $NO_X$ which flows out from the upstream side exhaust purification catalyst 20 at the time $t_4$, can be quickly decreased. Therefore, the outflow of unburned gas and $NO_X$ from the upstream side exhaust purification catalyst 20 can be suppressed.

Further, according to the air-fuel ratio control of the present embodiment, at the time $t_1$, the target air-fuel ratio is set to the lean set air-fuel ratio, then the outflow of unburned gas from the upstream side exhaust purification catalyst 20 stops and the oxygen storage amount OSAsc of the upstream side exhaust purification catalyst 20 is restored to a certain extent, and then at the time $t_3$, the target air-fuel ratio is switched to the slight lean set air-fuel ratio. By reducing the difference between the target air-fuel ratio and the stoichiometric air-fuel ratio in this way, from the time $t_3$ to the time $t_4$, the speed of increase of the oxygen storage amount OSAsc of the upstream side exhaust purification catalyst 20 can be slowed. Due to this, the time interval from the time $t_3$ to the time $t_4$ can be longer. As a result, it is possible to decrease the amount of flow of $NO_X$ or unburned gas from the upstream side exhaust purification catalyst 20 per unit time. Furthermore, according to the above air-fuel ratio control, it is possible to keep small the amount of outflow, when, at the time $t_4$, $NO_X$ flows out from the upstream side exhaust purification catalyst 20. Therefore, the outflow of $NO_X$ from the upstream side exhaust purification catalyst 20 can be suppressed.

In addition, according to the air-fuel ratio control of the present embodiment, at the time $t_4$, the target air-fuel ratio is set to the rich set air-fuel ratio, then the outflow of $NO_X$ (oxygen) from the upstream side exhaust purification catalyst 20 stops and the oxygen storage amount OSAsc of the upstream side exhaust purification catalyst 20 decreases by a certain extent, ant then, at the time $t_6$, the target air-fuel ratio is switched to the slight rich set air-fuel ratio. By reducing the difference between the target air-fuel ratio and the stoichiometric air-fuel ratio in this way, from the time $t_6$ to the time $t_7$ (time of performing control corresponding to time $t_1$), the speed of decrease of the oxygen storage amount OSAsc of the upstream side exhaust purification catalyst 20 can be slowed. Due to this, the time interval from the time $t_6$ to the time $t_7$ can be longer. As a result, the amount of outflow of $NO_X$ or unburned gas from the upstream side exhaust purification catalyst 20 per unit time can be decreased. Furthermore, according to the above air-fuel ratio control, the amount of outflow when, at the time $t_7$, unburned gas flows out from the upstream side exhaust purification catalyst 20 can be kept small. Therefore, outflow of unburned gas from the upstream side exhaust purification catalyst 20 can be suppressed.

Figure 3:
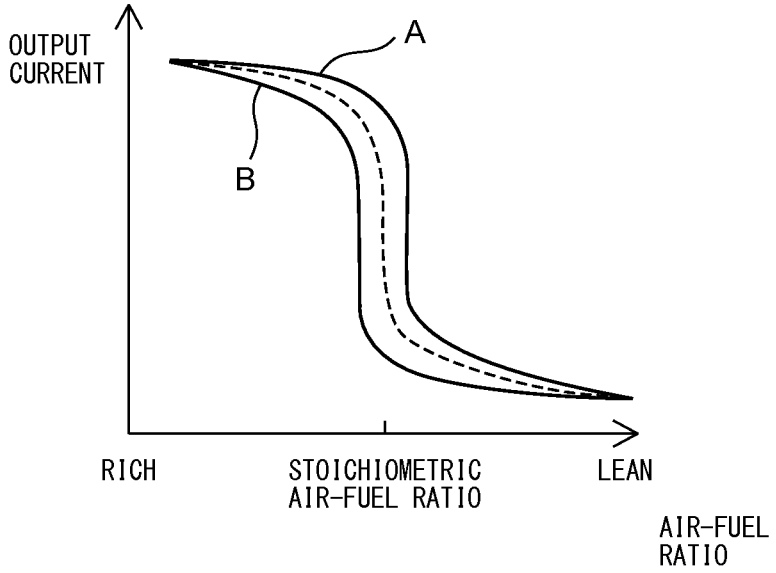
FIG. 3 is a view which shows the relationship between an exhaust air-fuel ratio and output voltage in an oxygen sensor.

Furthermore, in the present embodiment, as the sensor which detects the air-fuel ratio of the exhaust gas at the downstream side, the air-fuel ratio sensor 41 which has the configuration shown in FIG. 4 is used. In this air-fuel ratio sensor 41, different from an oxygen sensor, there is no hysteresis corresponding to the direction of change of the exhaust air-fuel ratio as shown in FIG. 3. Therefore, according to the air-fuel ratio sensor 41, the response to the actual exhaust air-fuel ratio is high, and the outflow of unburned gas and oxygen (and $NO_X$) from the upstream side exhaust purification catalyst 20 can be quickly detected. Therefore, by this as well, according to the present embodiment, it is possible to suppress the outflow of unburned gas and $NO_X$ (and oxygen) from the upstream side exhaust purification catalyst 20.

Further, in an exhaust purification catalyst which can store oxygen, if maintaining the oxygen storage amount substantially constant, the oxygen storage ability drops. Therefore, in order to maintain the oxygen storage ability as much as possible, it is necessary to make the oxygen storage amount change up and down at the time of use of the exhaust purification catalyst. According to the air-fuel ratio control according to the present embodiment, the oxygen storage ability of the upstream side exhaust purification catalyst 20 repeatedly changes up and down between near zero and near the maximum oxygen storage amount. Therefore, the oxygen storage amount OSAsc of the upstream side exhaust purification catalyst 20 can be maintained as high as possible.

<Explanation of Specific Control>

Figure 9:
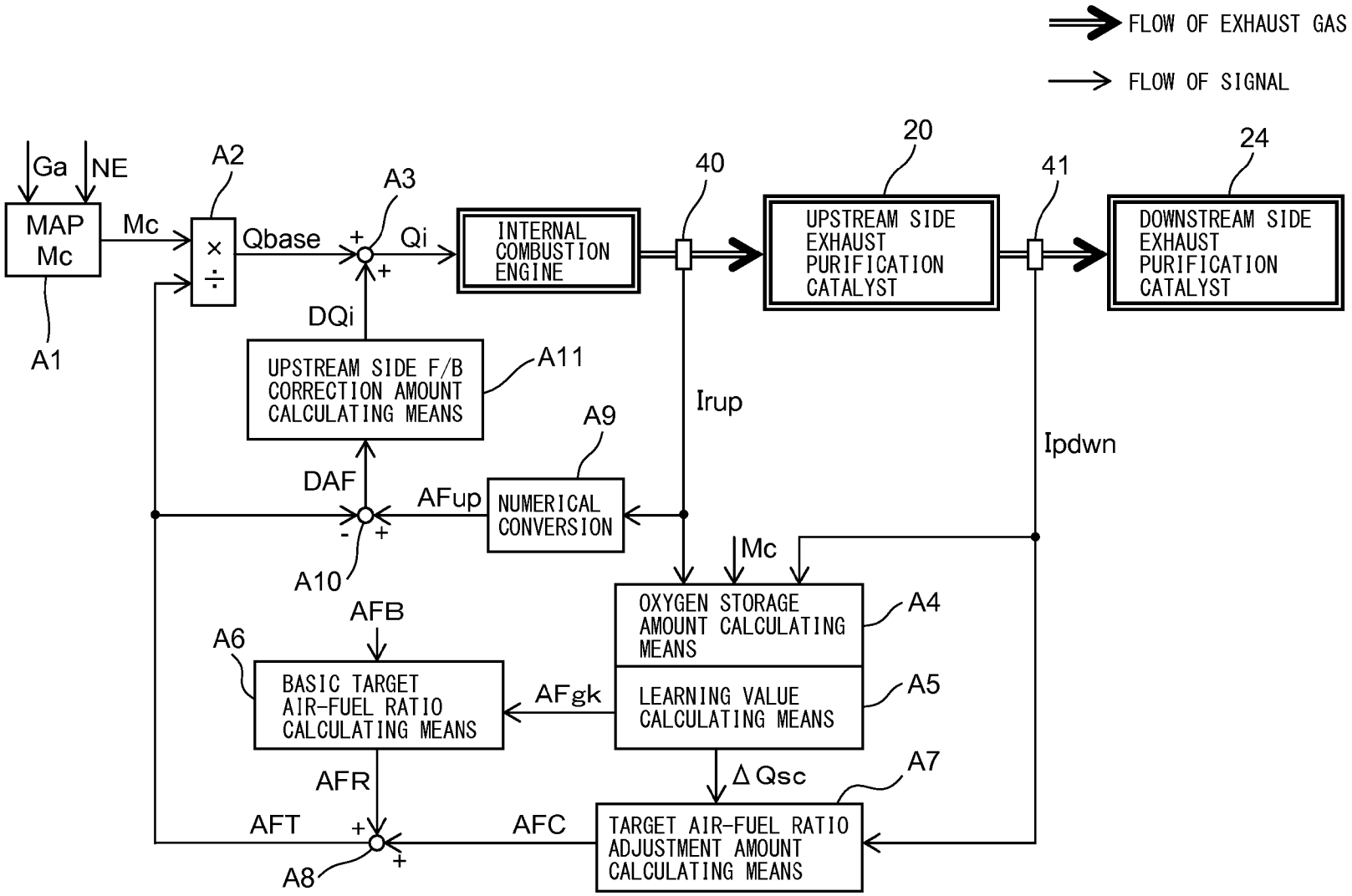
FIG. 9 is a functional block diagram of a control system.
Figure 10:
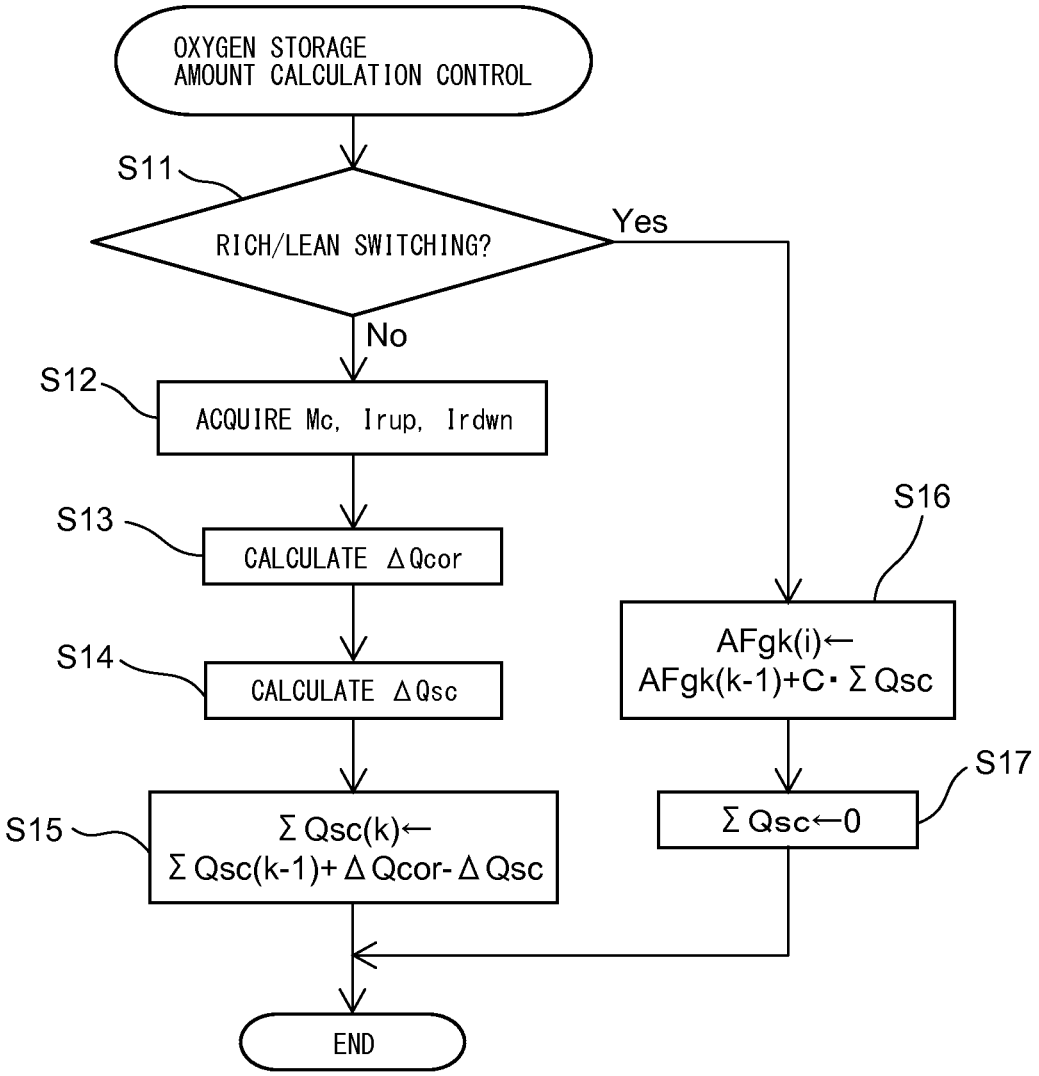
FIG. 10 is a flow chart which shows a control routine of control for estimating an oxygen storage amount.
Figure 11:
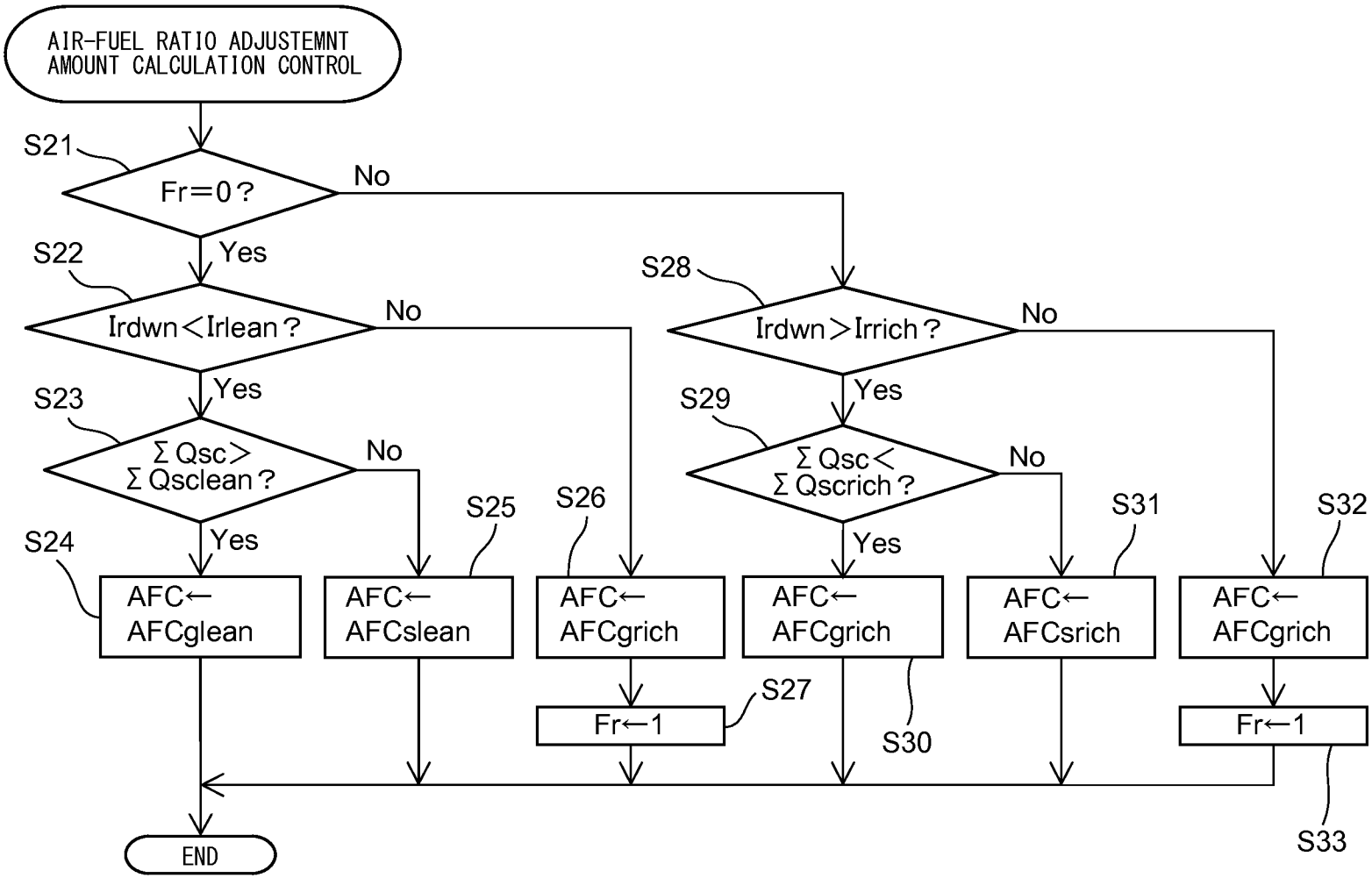
FIG. 11 is a flow chart which shows a control routine of control for calculation of an air-fuel ratio adjustment amount.

Next, referring to FIGS. 9 to 11, a control system in the above embodiment will be specifically explained. The control system in the present embodiment, as shown by the functional block diagram of FIG. 9, is configured including the functional blocks A1 to A11. Below, each functional block will be explained while referring to FIG. 9.

<Calculation of Fuel Injection>

First, calculation of the fuel injection will be explained. In calculating the fuel injection, the cylinder intake air calculating means A1, basic fuel injection calculating means A2, and fuel injection calculating means A3 are used.

The cylinder intake air calculating means A1 calculates the intake air amount Mc to each cylinder based on the intake air flow rate Ga measured by the air flow meter 39, the engine speed NE calculated based on the output of the crank angle sensor 44, and the map or calculation formula stored in the ROM 34 of the ECU 31.

The basic fuel injection calculating means A2 divides the cylinder intake air amount Mc, which is calculated by the cylinder intake air calculating means A1, by the target air-fuel ratio AFT which is calculated by the later explained target air-fuel ratio setting means A6 to thereby calculate the basic fuel injection amount Qbase (Qbase=Mc/AFT).

The fuel injection calculating means A3 adds the basic fuel injection amount Qbase calculated by the basic fuel injection calculating means A2 and the later explained F/B correction amount DQi, to calculate the fuel injection amount Qi (Qi=Qbase+DQi). The fuel injector 11 is commanded to inject fuel so that the fuel of the fuel injection amount Qi which was calculated in this way is injected.

<Calculation of Target Air-Fuel Ratio>

Next, calculation of the target air-fuel ratio will be explained. In calculation of the target air-fuel ratio, the oxygen storage amount calculating means A4, learning value estimating means A5, basic target air-fuel ratio calculating means A6, target air-fuel ratio adjustment amount calculating means A7, and target air-fuel ratio setting means A8 are used.

The oxygen storage amount calculating means A4 calculates the cumulative value ΣQsc of flow amount difference as a value which indicates the oxygen storage amount of the upstream side exhaust purification catalyst 20, based on the cylinder intake air amount Mc which was calculated by the cylinder intake air amount calculating means A1, the output current Irup of the upstream side air-fuel ratio sensor 40, and the output current Irdwn of the downstream side air-fuel ratio sensor 41. Further, the learning value calculating means A5 calculates the learning value AFgk of the air-fuel ratio deviation, based on the cumulative value ΣQsc of flow amount difference which was calculated at the oxygen storage amount calculating means A4. Specifically, the oxygen storage amount calculating means A4 and the learning value calculating means A5 calculate the cumulative value ΣQsc of flow amount difference and learning value AFgk of the air-fuel ratio deviation, based on the flow chart shown in FIG. 10.

FIG. 10 is a flow chart which shows the control routine of the control for calculation of the cumulative value ΣQsc of flow amount difference and learning value AFgk of the air-fuel ratio deviation. The illustrated control routine is performed by interruption at certain time intervals.

First, at step S11, it is judged if, at the later explained target air-fuel ratio adjustment amount calculating means A7, the air-fuel ratio adjustment amount AFC is changed from positive to negative or from negative to positive. That is, at step S11, it is judged if the target air-fuel ratio has been switched from rich to lean or from lean to rich.

When, at step S11, it is judged that the air-fuel ratio adjustment amount AFC has not been changed between positive and negative, the routine proceeds to step S12. At step S12, the cylinder intake air amount Mc which was calculated by the cylinder intake air amount calculating means A1, the output current Irup of the upstream side air-fuel ratio sensor 40, and the output current Irdwn of the downstream side air-fuel ratio sensor 41 are acquired. Note that, as the cylinder intake air amount Mc, not only the current cylinder intake air amount Mc, but also the cylinder intake air amount Mc in a plurality of past cycles is obtained.

Next, at step S13, the inflowing unburned gas excess/deficient flow amount ΔQcor is calculated based on the cylinder intake air amount Mc of several cycles before, which several cycles corresponds to the delay from when the intake gas is sucked into the combustion chamber 5 to when the gas reaches the upstream side air-fuel ratio sensor 40, and the output current Irup of the upstream side air-fuel ratio sensor 40. Specifically, this is calculated by multiplying the cylinder intake air amount Mc of a given number of cycles before with the output current Irup of the upstream side air-fuel ratio sensor 40 and a given coefficient K ($\Delta Qcor=K\cdot Mc\cdot Irup$).

At step S14, the outflowing unburned gas excess/deficient flow amount ΔQsc is calculated based on the cylinder intake air amount Mc of several cycles before, which several cycle corresponds to the delay from when the intake gas is sucked into the combustion chamber 5 to when the gas reaches the downstream side air-fuel ratio sensor 41, and the output current Irdwn of the downstream side air-fuel ratio sensor. Specifically, this is calculated by multiplying the cylinder intake air amount Mc of a given number of cycles before with the output current Irdwn of the downstream side air-fuel ratio sensor 41 and a given coefficient K ($\Delta Qsc=K\cdot Mc\cdot Irdwn$).

Next, at step S15, the cumulative value ΣQsc of the flow amount difference is calculated based on the inflowing unburned gas excess/deficient flow amount ΔQcor which is calculated at step S13 and the outflowing unburned gas excess/deficient flow amount ΔQsc which is calculated at step S14, by the following formula (3). Note that, in the following formula (3), "k" expresses the number of times of calculation:

$$\Sigma Qsc(k)=\Sigma Qsc(k-1)+\Delta Qcor-\Delta Qsc \quad (3)$$

On the other hand, when it is judged at step S11 that the air-fuel ratio adjustment amount AFC has been changed between positive and negative, that is, when it is judged that the target air-fuel ratio has been switched from rich to lean or lean to rich, the routine proceeds to step S16. At step S16, using the above formula (2), the learning value of the air-fuel ratio deviation AFgk is updated. Next, at step S17, the cumulative value ΣQsc of flow amount difference is reset to 0 and the control routine is ended.

Returning again to FIG. 9, at the basic target air-fuel ratio calculating means A6, the value acquired by adding the learning value AFgk of the air-fuel ratio deviation to the base air-fuel ratio AFB which becomes the center of air-fuel ratio control (in the present embodiment, the stoichiometric air-fuel ratio) is calculated as the basic target air-fuel ratio AFR. The basic target air-fuel ratio AFB becomes the same value as the base air-fuel ratio when the target air-fuel ratio and the air-fuel ratio of the exhaust gas which actually flows into the upstream side exhaust purification catalyst 20 always conform to each other.

At the target air-fuel ratio adjustment amount calculating means A7, the air-fuel ratio adjustment amount AFC of the target air-fuel ratio is calculated, based on the cumulative value ΣQsc of flow amount difference which is calculated by the oxygen storage amount calculating means A4 and the output current Irdwn of the downstream side air-fuel ratio sensor 41. Specifically, the air-fuel ratio adjustment amount AFC is set based on the flow chart shown in FIG. 11.

FIG. 11 is a flow chart which shows the control routine of the calculation control of the air-fuel ratio adjustment amount AFC. The illustrated control routine is performed by interruption at certain time intervals.

As shown in FIG. 11, first, at step S21, it is judged if the rich flag Fr is set to "1". The rich flag Fr is a flag which is set to "1" when the target air-fuel ratio is set to the rich air-fuel ratio (that is, slight rich set air-fuel ratio or rich set air-fuel ratio) and is set to "0" when it is set to the lean air-fuel ratio (that is, slight lean set air-fuel ratio or lean set air-fuel ratio). When, at step S21, the rich flag Fr is set to 0, that is, when it is judged that the target air-fuel ratio is set to the lean air-fuel ratio, the routine proceeds to step S22.

At step S22, it is judged if the output current Irdwn of the downstream side air-fuel ratio sensor 41 is smaller than the lean judgment reference value Irlean. If the oxygen storage amount OSAsc of the upstream side exhaust purification catalyst 20 is small and the exhaust gas flowing out from the upstream side exhaust purification catalyst 20 does not contain much oxygen at all, it is judged that the output current Irdwn of the downstream side air-fuel ratio sensor 41 is smaller than the lean judgment reference value Irlean, and thus the routine proceeds to step S23.

At step S23, it is judged if the cumulative value ΣQsc of flow amount difference is larger than the reference cumulative value ΣQsclean of lean degree change. If the oxygen storage amount OSAsc of the upstream side exhaust purification catalyst 20 is small and thus the cumulative value ΣQsc of flow amount difference is larger than the reference cumulative value ΣQsclean of lean degree change (that is, times $t_1$ to $t_3$ of FIG. 8), the routine proceeds to step S24. At step S24, the air-fuel ratio adjustment amount AFC is set to the lean set adjustment amount AFCglean and the control routine is ended.

Then, if the oxygen storage amount OSAsc of the upstream side exhaust purification catalyst 20 increases and thus the cumulative value ΣQsc of flow amount difference decreases, at the next control routine, at step S23, it is judged that the cumulative value ΣQsc of flow amount difference is the reference cumulative value ΣQsclean of lean degree change or less, and thus the routine proceeds to step S25 (corresponding to time $t_3$ at FIG. 8). At step S25, the air-fuel ratio adjustment amount AFC is set to the slight lean set adjustment amount AFCslean and then the control routine is ended.

If the oxygen storage amount OSAsc of the upstream side exhaust purification catalyst 20 is further increased and oxygen starts to flow out from the upstream side exhaust purification catalyst 20, at the next control routine, at step S22, it is judged that the output current Irdwn of the downstream side air-fuel ratio sensor 41 is the lean judgment reference value Irlean or more, and then the routine proceeds to step S26 (corresponding to time $t_4$ at FIG. 8). At step S26, the air-fuel ratio adjustment amount AFC is set to the rich set adjustment amount AFCgrich. Next, at step S27, the rich flag Fr is set to "1", and then the control routine is made to end.

If the rich flag Fr is set to "1", at the next control routine, the routine proceeds from step S21 to step S28. At step S28, it is judged if the output current Irdwn of the downstream side air-fuel ratio sensor 41 is larger than the rich judgment reference value Irrich. If the oxygen storage amount OSAsc of the upstream side exhaust purification catalyst 20 is large and thus the exhaust gas flowing out from the upstream side exhaust purification catalyst 20 does not contain much unburned gas at all, it is judged that the output current Irdwn of the downstream side air-fuel ratio sensor 41 is larger than the rich judgment reference value Irrich and the routine proceeds to step S29.

At step S29, it is judged if the cumulative value ΣQsc of flow amount difference is smaller than the reference cumulative value ΣQscrich of rich degree change. If the oxygen storage amount OSAsc of the upstream side exhaust purification catalyst 20 is large and thus the cumulative value ΣQsc of flow amount difference is smaller than the cumulative value ΣQscrich of rich degree change (that is, the times $t_4$ to $t_6$ of FIG. 8), the routine proceeds to step S30. At step S30, the air-fuel ratio adjustment amount AFC is set to the rich set adjustment amount AFCgrich, and then the control routine is ended.

Then, if the oxygen storage amount OSAsc of the upstream side exhaust purification catalyst 20 decreases and thus the cumulative value ΣQsc of flow amount difference increases, at the next control routine, at step S29, it is judged that the cumulative value ΣQsc of flow amount difference is the reference cumulative value ΣQscrich of rich degree change or more, and then the routine proceeds to step S31 (corresponding to time $t_6$ at FIG. 8). At step S31, the air-fuel ratio adjustment amount AFC is set to the slight rich set adjustment amount AFCsrich, and then the control routine is ended.

If the oxygen storage amount OSAsc of the upstream side exhaust purification catalyst 20 further decreases and unburned gas starts to flow out from the upstream side exhaust purification catalyst 20, at the next control routine, at step S28, it is judged that the output current Irdwn of the downstream side air-fuel ratio sensor 41 is the rich judgment reference value Irrich or less, and then the routine proceeds to step S32 (corresponding to the time $t_1$ at FIG. 8). At step S32, the air-fuel ratio adjustment amount AFC is set to the lean set adjustment amount AFCglean. Next, at step S33, the rich flag Fr is set to 0 and the control routine is ended.

The target air-fuel ratio setting means A8 adds the basic target air-fuel ratio AFR which was calculated at the basic target air-fuel ratio calculating means A6 and the air-fuel ratio adjustment amount AFC which was calculated at the target air-fuel ratio adjustment amount calculating means A7 to calculate the target air-fuel ratio AFT. Therefore, the target air-fuel ratio AFT is set to either of the slight rich set air-fuel ratio which is slightly richer than the stoichiometric air-fuel ratio (when air-fuel ratio adjustment amount AFC is slight rich set adjustment amount AFCsrich), the rich set air-fuel ratio which is considerably richer than the stoichiometric air-fuel ratio (when air-fuel ratio adjustment amount AFC is rich set adjustment amount AFCgrich), the slight lean set air-fuel ratio which is slightly leaner than the stoichiometric air-fuel ratio (when air-fuel ratio adjustment amount AFC is slight rich set adjustment amount AFCslean), and lean set air-fuel ratio which is considerably leaner than stoichiometric air-fuel ratio (when air-fuel ratio adjustment amount AFC is lean set adjustment amount AFCglean). The thus calculated target air-fuel ratio AFT is input to the basic fuel injection amount calculating means A2 and later explained air-fuel ratio difference calculating means A8.

<Calculation of F/B Correction Amount>

Next, calculation of the F/B correction amount based on the output current Irup of the upstream side air-fuel ratio sensor 40 will be explained. In calculation of the F/B correction amount, the numerical value converting means A9, air-fuel ratio difference calculating means A10, and F/B correction amount calculating means A11 are used.

The numerical value converting means A9 calculates the upstream side exhaust air-fuel ratio AFup, based on the output current Irup of the upstream side air-fuel ratio sensor 40 and a map or calculation formula (for example, the map shown in FIG. 6) which defines the relationship between the output current Irup and the air-fuel ratio of the air-fuel ratio sensor 40. Therefore, the upstream side exhaust air-fuel ratio AFup corresponds to the air-fuel ratio of the exhaust gas flowing into the upstream side exhaust purification catalyst 20.

The air-fuel ratio difference calculating means A10 subtracts the target air-fuel ratio AFT calculated by the target air-fuel ratio setting means A8 from the upstream side exhaust air-fuel ratio AFup calculated by the numerical value converting means A9 to thereby calculate the air-fuel ratio difference DAF (DAF=AFup-AFT). This air-fuel ratio difference DAF is a value which expresses excess/deficiency of the amount of fuel fed with respect to the target air-fuel ratio AFT.

The F/B correction amount calculating means A11 processes the air-fuel ratio difference DAF calculated by the air-fuel ratio difference calculating means A10 by proportional integral derivative processing (PID processing) to thereby calculate the F/B correction amount DFi for compensating for the excess/deficiency of the amount of feed of fuel based on the following equation (4). The thus calculated F/B correction amount DFi is input to the fuel injection calculating means A3.

$$DFi=Kp\cdot DAF+Ki\cdot SDAF+Kd\cdot DDAF \quad (4)$$

Note that, in the above equation (4), Kp is a preset proportional gain (proportional constant), Ki is a preset integral gain (integral constant), and Kd is a preset derivative gain (derivative constant). Further, DDAF is the time derivative value of the air-fuel ratio difference DAF and is calculated by dividing the difference between the currently updated air-fuel ratio difference DAF and the previously updated air-fuel ratio difference DAF by the time corresponding to the updating interval. Further, SDAF is the time derivative value of the air-fuel ratio difference DAF. This time derivative value DDAF is calculated by adding the previously updated time derivative value DDAF and the currently updated air-fuel ratio difference DAF (SDAF=DDAF+DAF).

Note that, in the above embodiment, the air-fuel ratio of the exhaust gas flowing into the upstream side exhaust purification catalyst 20 is detected by the upstream side air-fuel ratio sensor 40. However, the precision of detection of the air-fuel ratio of the exhaust gas flowing into the upstream side exhaust purification catalyst 20 does not necessarily have to be high, and therefore, for example, the air-fuel ratio of the exhaust gas flowing into the upstream side exhaust purification catalyst 20 may be estimated based on the fuel injection amount from the fuel injector 11 and output of the air flow meter 39.

Figure 12:
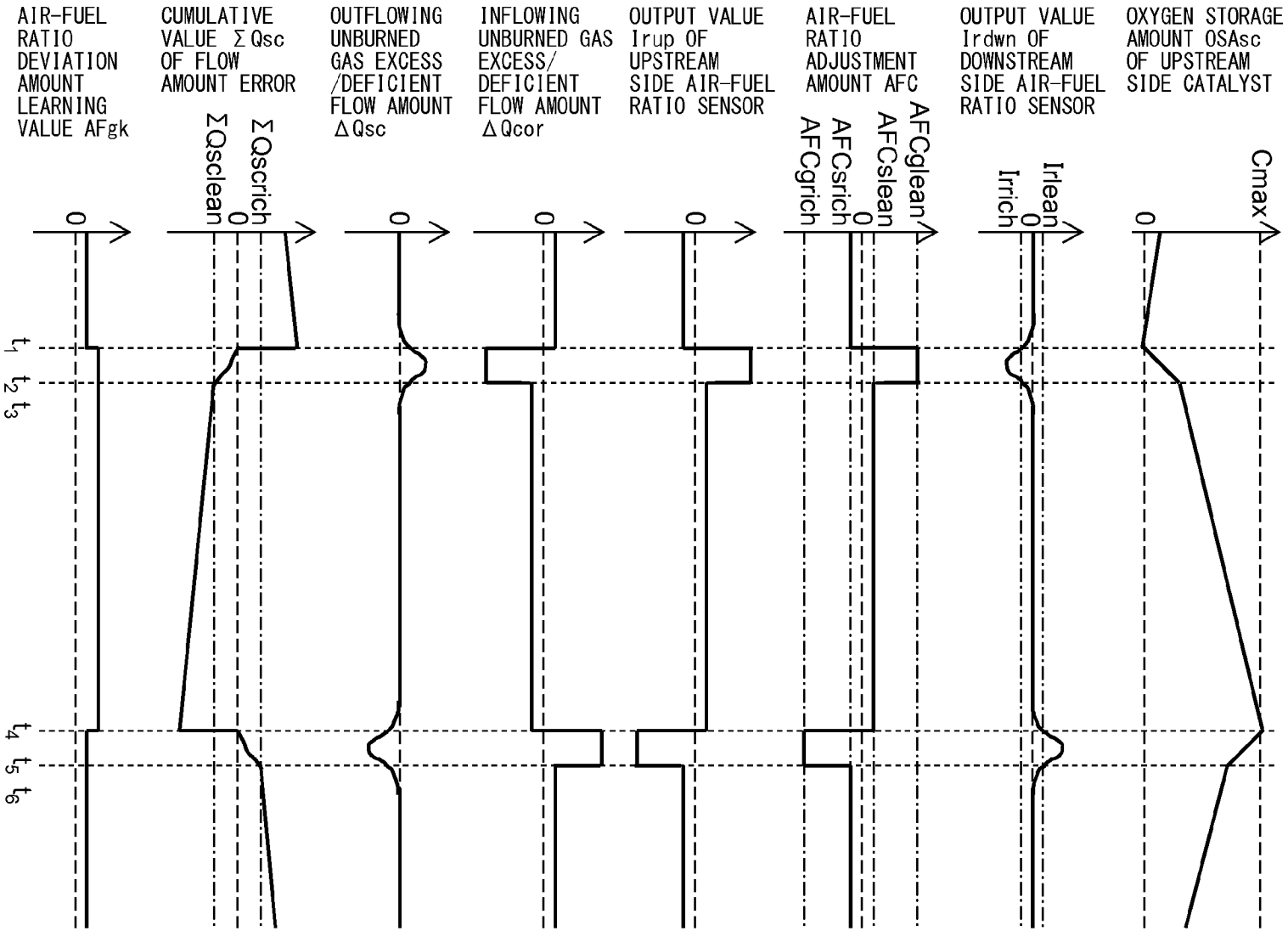
FIG. 12 is a time chart of the oxygen storage amount of the upstream side exhaust purification catalyst, etc.

Further, in the above embodiment, when the cumulative value ΣQsc of flow amount difference becomes the reference cumulative value ΣQsclean of lean degree change or less, the target air-fuel ratio is changed to reduce the difference from the stoichiometric air-fuel ratio. However, the timing for changing the target air-fuel ratio so as to make the difference from the stoichiometric air-fuel ratio smaller may be any time between the times $t_1$ and $t_4$. For example, as shown in FIG. 12, when the output current Irdwn of the downstream side air-fuel ratio sensor 41 becomes the lean judgment reference value Irrich or more, the target air-fuel ratio may be changed so as to make the difference from the stoichiometric air-fuel ratio smaller.

Similarly, in the above embodiment, when the cumulative value ΣQsc of flow amount difference becomes the reference cumulative value ΣQscrich of rich degree change or more, the target air-fuel ratio is changed so as to make the difference from the stoichiometric air-fuel ratio smaller. However, the timing for changing the target air-fuel ratio so as to make the difference from the stoichiometric air-fuel ratio smaller may be any time between the times $t_4$ to $t_7$ ($t_1$). For example, as shown in FIG. 12, when the output current Irdwn of the downstream side air-fuel ratio sensor 41 becomes the rich judgment reference value Irrich or less, the target air-fuel ratio may be changed so as to make the difference from the stoichiometric air-fuel ratio smaller.

Furthermore, in the above embodiment, between the times $t_3$ to $t_4$ and between the times $t_6$ to $t_7$ ($t_1$), the target air-fuel ratio is fixed to the slight lean set air-fuel ratio or slight rich set air-fuel ratio. However, in these time periods, the target air-fuel ratio may also be set so that the difference becomes smaller in stages or may also be set so that the difference becomes continuously smaller.

Summarizing these together, according to the present invention, the ECU 31 can be said to comprise: an air-fuel ratio lean switching means for changing the target air-fuel ratio of the exhaust gas flowing into the upstream side exhaust purification catalyst 20 to a lean set air-fuel ratio when an exhaust air-fuel ratio detected by the downstream side air-fuel ratio sensor 41 becomes a rich air-fuel ratio; a lean degree lowering means for changing the target air-fuel ratio to a lean air-fuel ratio with a smaller difference from the stoichiometric air-fuel ratio than the lean set air-fuel ratio, at a timing after the air-fuel ratio lean switching means changes the air-fuel ratio and before the exhaust air-fuel ratio detected by the downstream side air-fuel ratio detection device becomes the lean air-fuel ratio; an air-fuel ratio rich switching means for changing the target air-fuel ratio to a rich set air-fuel ratio when the exhaust air-fuel ratio detected by the downstream side air-fuel ratio sensor 41 becomes the lean air-fuel ratio; and a rich degree lowering means for changing the target air-fuel ratio to a rich air-fuel ratio with a smaller difference from the stoichiometric air-fuel ratio than the rich set air-fuel ratio, at a timing after the air-fuel ratio lean switching means changes the air-fuel ratio and before the exhaust air-fuel ratio detected by the downstream side air-fuel ratio sensor 41 becomes the rich air-fuel ratio.

Second Embodiment

Next, referring to FIGS. 13 to 17, a control system of an internal combustion engine according to a second embodiment of the present invention will be explained. The configuration and control of the control system of an internal combustion engine according to the second embodiment are basically similar to the configuration and control of the control system of an internal combustion engine according to the above embodiments. However, in the above embodiments, the sensor applied voltage of the downstream side air-fuel ratio sensor is constant, while in the present embodiment, the sensor applied voltage is changed in accordance with the situation.

<Output Characteristic of Air-Fuel Ratio Sensor>

Figure 13:
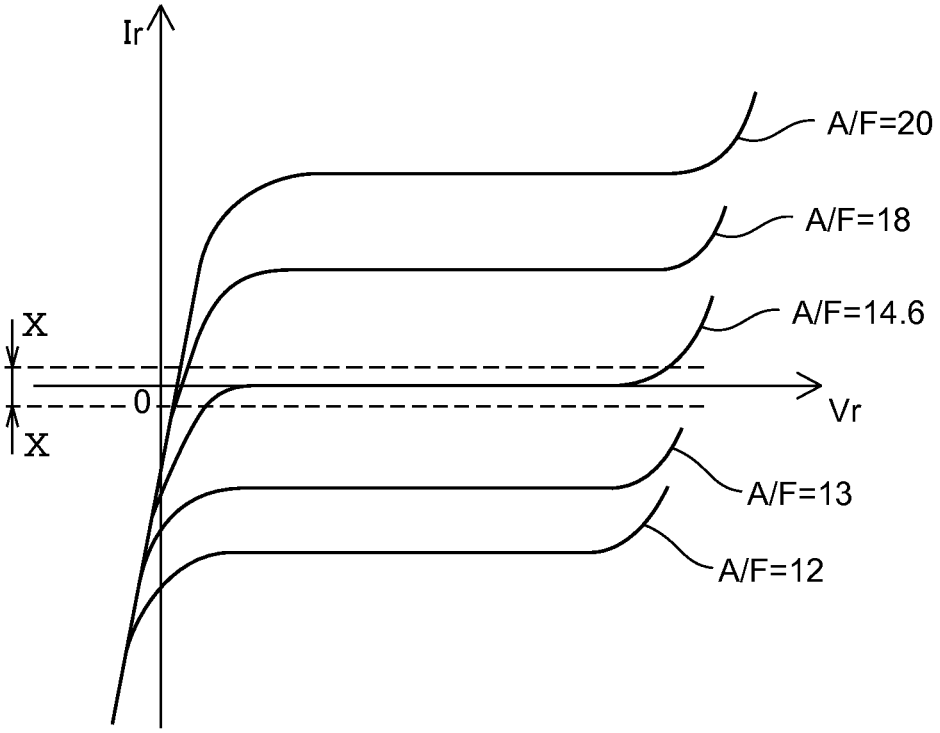
FIG. 13 is a view which shows the relationship between a sensor applied voltage and output current at different the exhaust air-fuel ratios.

The upstream side air-fuel ratio sensor 40 and the downstream side air-fuel ratio sensor 41 of the present embodiment are configured and operated as explained using FIGS. 4 and 5, similarly to the air-fuel ratio sensors 40 and 41 of the first embodiment. These air-fuel ratio sensors 40 and 41 have the voltage-current (V-I) characteristic such as shown in FIG. 13. As will be understood from FIG. 13, in the region where the sensor applied voltage Vr is not more than 0 and near 0, when the exhaust air-fuel ratio is constant, if the sensor applied voltage Vr gradually increases from a negative value, the output current Ir increases along with this.

That is, in this voltage region, since the sensor applied voltage Vr is low, the flow rate of oxygen ions which can move through the solid electrolyte layer 51 is small. For this reason, the flow rate of oxygen ions which can move through the solid electrolyte layer 51 becomes smaller than the rate of inflow of exhaust gas through the diffusion regulating layer 54 and, accordingly, the output current Ir changes in accordance with the flow rate of oxygen ions which can move through the solid electrolyte layer 51. The flow rate of oxygen ions which can move through the solid electrolyte layer 51 changes in accordance with the sensor applied voltage Vr, and, as a result, the output current increases along with the increase in the sensor applied voltage Vr. Note that, the voltage region where the output current Ir changes in proportion to the sensor applied voltage Vr in this way is called the "proportional region". Further, when the sensor applied voltage Vr is 0, the output current Ir becomes a negative value since an electromotive force E according to the oxygen concentration ratio is generated between the two lateral surfaces of the solid electrolyte layer 51, by the oxygen cell characteristic.

Then, if leaving the exhaust air-fuel ratio constant and gradually increasing the sensor applied voltage Vr, the ratio of increase of output current to the increase of the voltage will gradually become smaller and will finally substantially be saturated. As a result, even if increasing the sensor applied voltage Vr, the output current will no longer change much at all. This substantially saturated current is called the "limit current". Below, the voltage region where this limit current occurs will be called the "limit current region".

That is, in this limit current region, the sensor applied voltage Vr is high to a certain extent, and therefore the flow rate of oxygen ions which can move through the solid electrolyte layer 51 is large. Therefore, the flow rate of oxygen ions which can move through the solid electrolyte layer 51 becomes greater than the rate of inflow of exhaust gas through the diffusion regulating layer 54. Therefore, the output current Ir changes in accordance with the concentration of oxygen or concentration of unburned gas in the exhaust gas flowing into the measured gas chamber 57 through the diffusion regulating layer 54. Even if making the exhaust air-fuel ratio constant and changing the sensor applied voltage Vr, basically, the concentration of oxygen or concentration of unburned gas in the exhaust gas flowing into the measured gas chamber 57 through the diffusion regulating layer 54 does not change, and therefore the output voltage Ir does not change.

However, if the exhaust air-fuel ratio differs, the concentration of oxygen and concentration of unburned gas in the exhaust gas flowing into the measured gas chamber 57 through the diffusion regulating layer 54 also differ, and therefore the output current Ir changes in accordance with the exhaust air-fuel ratio. As will be understood from FIG. 13, between the lean air-fuel ratio and the rich air-fuel ratio, the direction of flow of the limit current is opposite. At the time of the lean air-fuel ratio, the absolute value of the limit current becomes larger the larger the air-fuel ratio, while at the time of the rich air-fuel ratio, the absolute value of the limit current becomes larger the smaller the air-fuel ratio.

Then, if holding the exhaust air-fuel ratio constant and further increasing the sensor applied voltage Vr, the output current Ir again starts to increase along with the increase in the voltage. If applying a high sensor applied voltage Vr in this way, the moisture which is contained in the exhaust gas breaks down on the exhaust side electrode 52. Along with this, current flows. Further, if further increasing the sensor applied voltage Vr, even with just breakdown of moisture, the current no longer becomes sufficient. At this time, the solid electrolyte layer 51 breaks down. Below, the voltage region where moisture and the solid electrolyte layer 51 break down in this way will be called the "moisture breakdown region".

Figure 14:
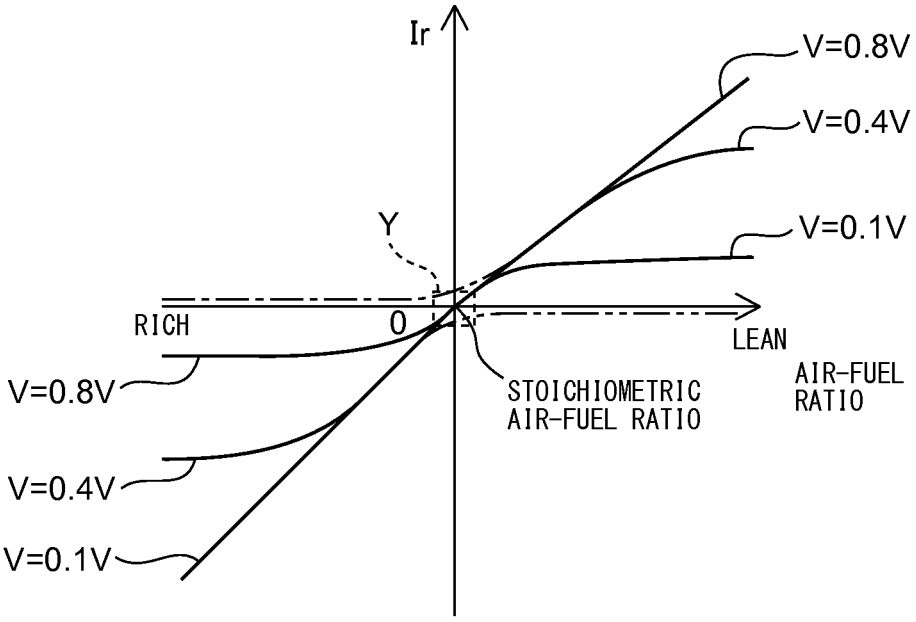
FIG. 14 is a view which shows the relationship between the exhaust air-fuel ratio and output current at different sensor applied voltages.

FIG. 14 is a view which shows the relationship between the exhaust air-fuel ratio and the output current Ir at different sensor applied voltages Vr. As will be understood from FIG. 14, if the sensor applied voltage Vr is 0.1V to 0.9V or so, the output current Ir changes in accordance with the exhaust air-fuel ratio at least near the stoichiometric air-fuel ratio. Further, as will be understood from FIG. 14, if sensor applied voltage Vr is 0.1V to 0.9V or so, near the stoichiometric air-fuel ratio, the relationship between the exhaust air-fuel ratio and the output current Ir is substantially the same regardless of the sensor applied voltage Vr.

On the other hand, as will be understood from FIG. 14, if the exhaust air-fuel ratio becomes lower than a certain exhaust air-fuel ratio or less, the output current Ir no longer changes much at all even if the exhaust air-fuel ratio changes. This certain exhaust air-fuel ratio changes in accordance with the sensor applied voltage Vr. It becomes higher the higher the sensor applied voltage Vr. For this reason, if making the sensor applied voltage Vr increase to a certain specific value or more, as shown in the figure by the one-dot chain line, no matter what the value of the exhaust air-fuel ratio, the output current Ir will no longer become 0.

On the other hand, if the exhaust air-fuel ratio becomes higher than a certain exhaust air-fuel ratio or more, the output current Ir no longer changes much at all even if the exhaust air-fuel ratio changes. This certain exhaust air-fuel ratio also changes in accordance with the sensor applied voltage Vr. It becomes lower the lower the sensor applied voltage Vr. For this reason, if making the sensor applied voltage Vr decrease to a certain specific value or less, as shown in the figure by the two-dot chain line, no matter what the value of the exhaust air-fuel ratio, the output current Ir will no longer become 0 (for example, when the sensor applied voltage Vr is set to 0V, the output current Ir does not become 0 regardless of the exhaust air-fuel ratio).

<Microscopic Characteristics Near Stoichiometric Air-Fuel Ratio>

The inventors of the present invention engaged in in-depth research whereupon they discovered that if viewing the relationship between the sensor applied voltage Vr and the output current Ir (FIG. 13) or the relationship between the exhaust air-fuel ratio and output current Ir (FIG. 14) macroscopically, they trend like explained above, but if viewing these relationships microscopically near the stoichiometric air-fuel ratio, they trend differently from the above. Below, this will be explained.

Figure 15:
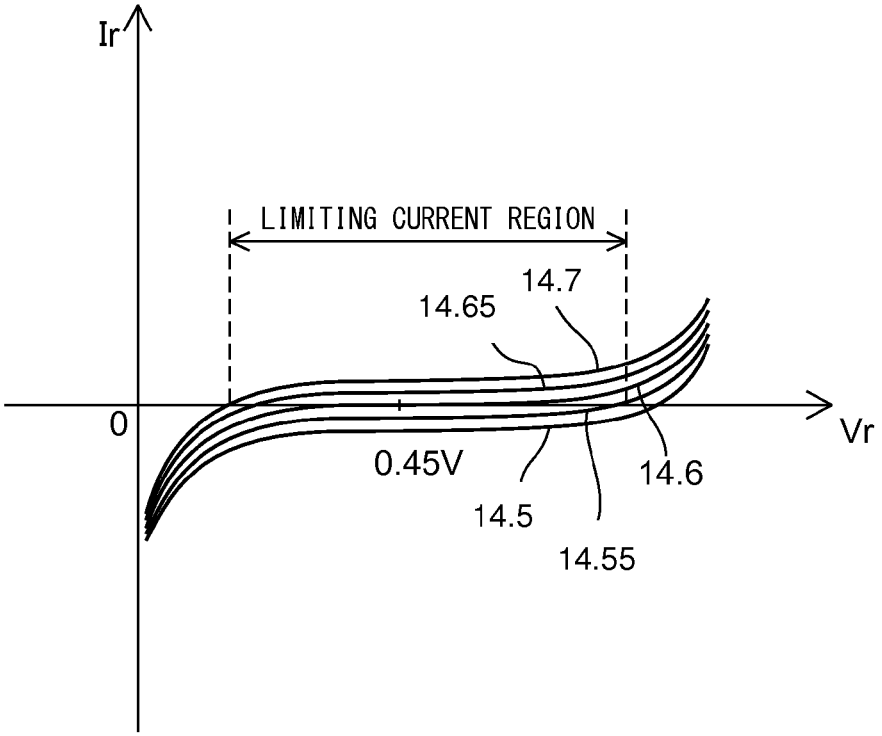
FIG. 15 is a view which shows enlarged the region which is shown by X-X in FIG. 13.

FIG. 15 is a view which shows enlarged the region where the output current Ir becomes near 0 (region shown by X-X in FIG. 13), regarding the voltage-current graph of FIG. 13. As will be understood from FIG. 15, even in the limit current region, when making the exhaust air-fuel ratio constant, the output current Ir also increases, though very slightly, along with the increase in the sensor applied voltage Vr. For example, considering the case where the exhaust air-fuel ratio is the stoichiometric air-fuel ratio (14.6) as an example, when the sensor applied voltage Vr is 0.45V or so, the output current Ir becomes 0. As opposed to this, if setting the sensor applied voltage Vr to lower than 0.45V by a certain extent (for example, 0.2V), the output current becomes a value lower than 0. On the other hand, if setting the sensor applied voltage Vr to higher than 0.45V by a certain extent (for example, 0.7V), the output current becomes a value higher than 0.

Figure 16:
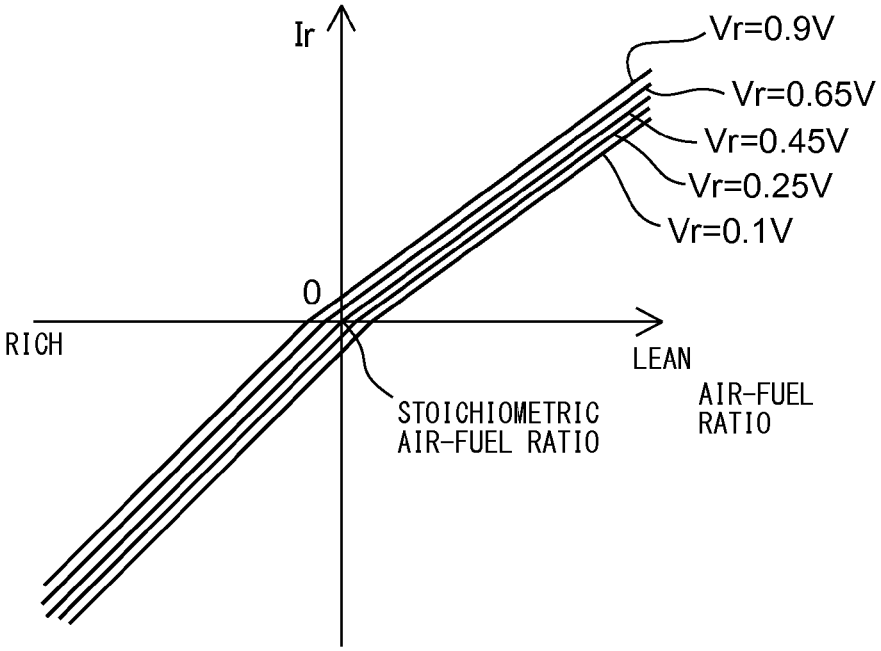
FIG. 16 is a view which shows enlarged the region which is shown by Y in FIG. 14.

FIG. 16 is a view which shows enlarged the region where the exhaust air-fuel ratio is near the stoichiometric air-fuel ratio and the output current Ir is near 0 (region shown by Y in FIG. 14), regarding the air-fuel ratio-current graph of FIG. 14. From FIG. 16, it will be understood that in the region near the stoichiometric air-fuel ratio, the output current Ir for the same exhaust air-fuel ratio slightly differs for each sensor applied voltage Vr. For example, in the illustrated example, when the exhaust air-fuel ratio is the stoichiometric air-fuel ratio, the output current Ir when the sensor applied voltage Vr is 0.45V becomes 0. Further, if setting the sensor applied voltage Vr to larger than 0.45V, the output current Ir also becomes larger than 0. If setting the sensor applied voltage Vr to smaller than 0.45V, the output current Ir also becomes smaller than 0.

In addition, from FIG. 16, it will be understood that the exhaust air-fuel ratio when the output current Ir is 0 (below, referred to as "exhaust air-fuel ratio at the time of zero current") differs for each sensor applied voltage Vr. In the illustrated example, when the sensor applied voltage Vr is 0.45V, the output current Ir becomes 0 when the exhaust air-fuel ratio is the stoichiometric air-fuel ratio. As opposed to this, if the sensor applied voltage Vr is larger than 0.45V, the output current Ir becomes 0 when the exhaust air-fuel ratio is richer than the stoichiometric air-fuel ratio. The larger the sensor applied voltage Vr becomes, the smaller the exhaust air-fuel ratio at the time of zero current. Conversely, if the sensor applied voltage Vr is smaller than 0.45V, the output current Ir becomes 0 when the exhaust air-fuel ratio is leaner than the stoichiometric air-fuel ratio. The smaller the sensor applied voltage Vr, the larger the exhaust air-fuel ratio at the time of zero current. That is, by making the sensor applied voltage Vr change, it is possible to change the exhaust air-fuel ratio at the time of zero current.

In this regard, the slope at FIG. 6, that is, the ratio of the amount of increase of the output current to the amount of increase of the exhaust air-fuel ratio (below, referred to as the "rate of change of the output current"), does not necessarily become the same even through similar production processes. Therefore, even with the same type of air-fuel ratio sensor, variations occur between specimens. In addition, even at the same air-fuel ratio sensor, the rate of change of output current changes due to aging, etc. As a result, even if using the same type of sensor which is configured to have the output characteristic shown by the solid line A in FIG. 17, depending on the sensor used or the time period of use, etc., as shown by the broken line B in FIG. 17, the rate of change of the output current will become small or, as shown by the one-dot chain line C, the rate of change of the output current will become large.

Therefore, even if using the same type of air-fuel ratio sensor to measure exhaust gas of the same air-fuel ratio, depending on the sensor used or the time period of use, etc., the output current of the air-fuel ratio sensor will differ. For example, when the air-fuel ratio sensor has an output characteristic such as shown by the solid line A, the output current when measuring the exhaust gas with an air-fuel ratio of $af_1$ becomes $I_2$. However, when the air-fuel ratio sensor has the output characteristic such as shown by the broken line B or one-dot chain line C, the output currents when measuring the exhaust gas with an air-fuel ratio of $af_1$ become $I_1$ and $I_3$ respectively, that is, output currents different from the above-mentioned $I_2$.

Figure 17:
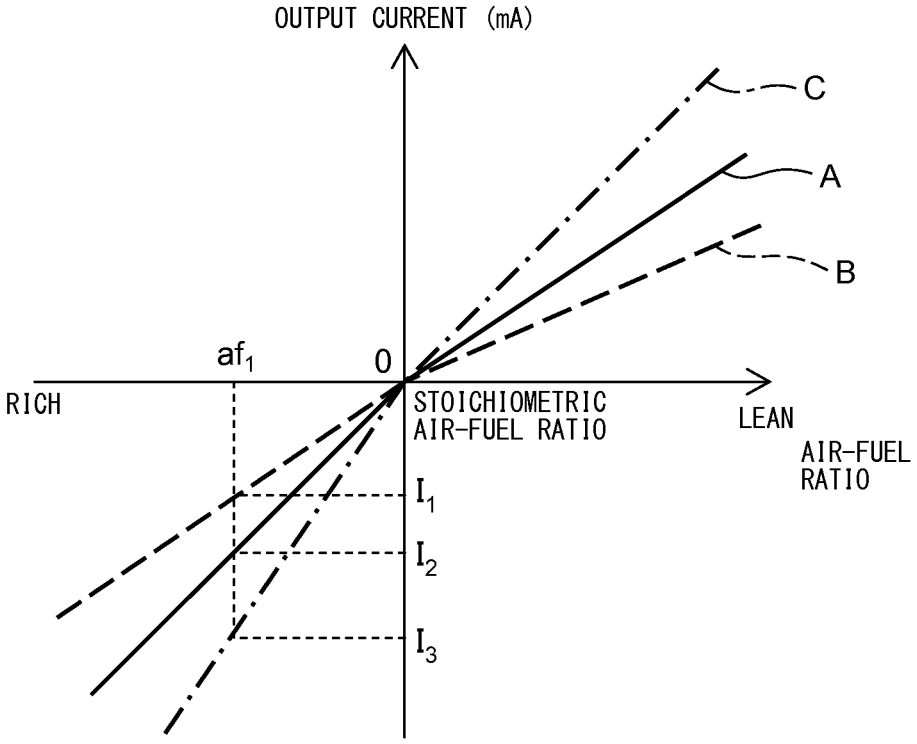
FIG. 17 is a view which shows the relationship between the air-fuel ratio of the air-fuel ratio sensor and the output current.

However, as will be understood from FIG. 17, even if variation occurs between specimens of an air-fuel ratio sensor or variations occur in the same air-fuel ratio sensor due to aging, etc., the exhaust air-fuel ratio at the time of zero current (in the example of FIG. 17, the stoichiometric air-fuel ratio) does not change much at all. That is, when the output current Ir becomes a value other than zero, it is difficult to accurately detect the absolute value of the exhaust air-fuel ratio, while when the output current Ir becomes zero, it is possible to accurately detect the absolute value of the exhaust air-fuel ratio (in the example of FIG. 17, stoichiometric air-fuel ratio).

Further, as explained using FIG. 16, in the air-fuel ratio sensors 40 and 41, by changing the sensor applied voltage Vr, it is possible to change the exhaust air-fuel ratio at the time of zero current. That is, if suitably setting the sensor applied voltage Vr, it is possible to accurately detect the absolute value of an exhaust air-fuel ratio other than the stoichiometric air-fuel ratio. In particular, when changing the sensor applied voltage Vr within a later explained "specific voltage region", it is possible to adjust the exhaust air-fuel ratio at the time of zero current only slightly with respect to the stoichiometric air-fuel ratio (14.6) (for example, within a range of ±1% (about 14.45 to about 14.75)). Therefore, by suitably setting the sensor applied voltage Vr, it becomes possible to accurately detect the absolute value of an air-fuel ratio which slightly differs from the stoichiometric air-fuel ratio.

Note that, by changing the sensor applied voltage Vr, it is possible to change the exhaust air-fuel ratio at the time of zero current. However, if changing the sensor applied voltage Vr so as to be larger than a certain upper limit voltage or smaller than a certain lower limit voltage, the amount of change in the exhaust air-fuel ratio at the time of zero current, with respect to the amount of change in the sensor applied voltage Vr, becomes larger. Therefore, in these voltage regions, if the sensor applied voltage Vr slightly shifts, the exhaust air-fuel ratio at the time of zero current greatly changes. Therefore, in this voltage region, to accurately detect the absolute value of the exhaust air-fuel ratio, it becomes necessary to precisely control the sensor applied voltage Vr. This is not that practical. Therefore, from the viewpoint of accurately detecting the absolute value of the exhaust air-fuel ratio, the sensor applied voltage Vr has to be a value within a "specific voltage region" between a certain upper limit voltage and a certain lower limit voltage.

In this regard, as shown in FIG. 15, the air-fuel ratio sensors 40 and 41 have a limit current region which is a voltage region where the output current Ir becomes a limit current for each exhaust air-fuel ratio. In the present embodiment, the limit current region when the exhaust air-fuel ratio is the stoichiometric air-fuel ratio is defined as the "specific voltage region".

Note that, as explained using FIG. 14, if increasing the sensor applied voltage Vr to a certain specific value (maximum voltage) or more, as shown in the figure by the one-dot chain line, no matter what value the exhaust air-fuel ratio is, the output current Ir will no longer become 0. On the other hand, if decreasing the sensor applied voltage Vr to a certain specific value (minimum voltage) or less, as shown in the figure by the two-dot chain line, no matter what value the exhaust air-fuel ratio, the output current Ir will no longer become 0.

Therefore, if the sensor applied voltage Vr is a voltage between the maximum voltage and the minimum voltage, there is an exhaust air-fuel ratio where the output current becomes zero. Conversely, if the sensor applied voltage Vr is a voltage higher than the maximum voltage or a voltage lower than the minimum voltage, there is no exhaust air-fuel ratio where the output current will become zero. Therefore, the sensor applied voltage Vr at least has to be able to be a voltage where the output current becomes zero when the exhaust air-fuel ratio is any air-fuel ratio, that is, a voltage between the maximum voltage and the minimum voltage. The above-mentioned "specific voltage region" is the voltage region between the maximum voltage and the minimum voltage.

<Applied Voltages at Different Air-Fuel Ratio Sensors>

In the present embodiment, in consideration of the above-mentioned microscopic characteristics near the above-mentioned stoichiometric air-fuel ratio, when the upstream side air-fuel ratio sensor 40 detects the air-fuel ratio of the exhaust gas, the sensor applied voltage Vrup at the upstream side air-fuel ratio sensor 40 is set to a voltage so that the output current becomes zero when the exhaust air-fuel ratio is the stoichiometric air-fuel ratio (in the present embodiment, 14.6) (for example, 0.45V). In other words, in the upstream side air-fuel ratio sensor 40, the sensor applied voltage Vrup is set so that the exhaust air-fuel ratio at the time of zero current is the stoichiometric air-fuel ratio.

Figure 18:
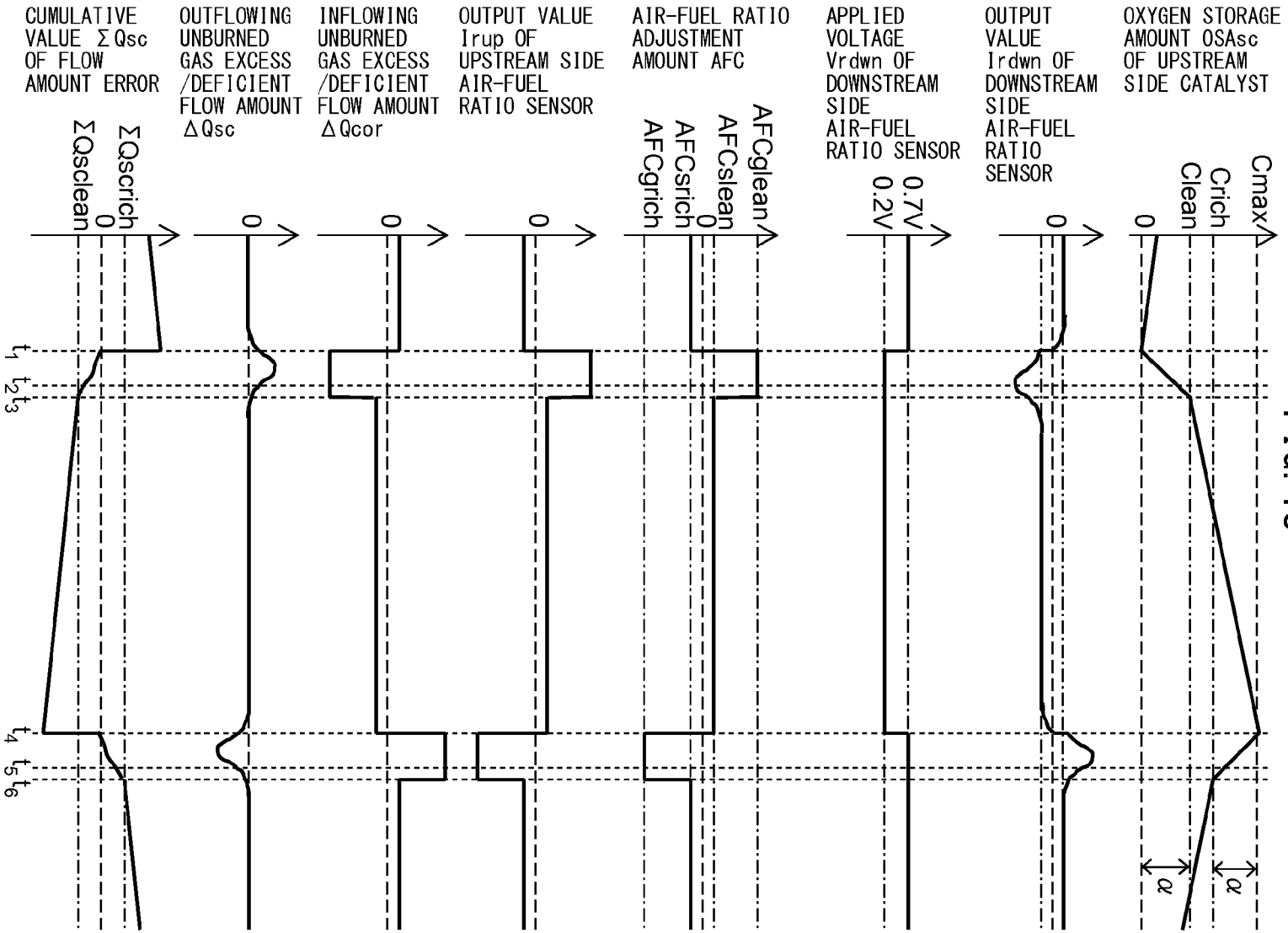
FIG. 18 is a time chart of the oxygen storage amount of the upstream side exhaust purification catalyst, etc.

On the other hand, when the target air-fuel ratio is the rich air-fuel ratio (that is, rich set air-fuel ratio or slight rich set air-fuel ratio), the sensor applied voltage Vr at the downstream side air-fuel ratio sensor 41, as shown in FIG. 18, is set to a voltage (for example, 0.7V) at which the output current becomes zero when the exhaust air-fuel ratio is a predetermined air-fuel ratio which is slightly richer than the stoichiometric air-fuel ratio (rich judgement air-fuel ratio). In other words, when the target air-fuel ratio is a rich air-fuel ratio, at the downstream side air-fuel ratio sensor 41, the sensor applied voltage Vrdwn is set so that the exhaust air-fuel ratio at the time of zero current is a rich judgement air-fuel ratio which is slightly richer than the stoichiometric air-fuel ratio.

On the other hand, as shown in FIG. 18, when the target air-fuel ratio is a lean air-fuel ratio (that is, lean set air-fuel ratio or slight lean set air-fuel ratio), the sensor applied voltage Vr at the downstream side air-fuel ratio sensor 41 is set to a voltage (for example, 0.2V) at which the output current becomes zero when the exhaust air-fuel ratio is a predetermined air-fuel ratio which is slightly leaner than the stoichiometric air-fuel ratio (lean judgement air-fuel ratio). In other words, when the target air-fuel ratio is the lean air-fuel ratio, at the downstream side air-fuel ratio sensor 41, the sensor applied voltage Vrdwn is set so that the exhaust air-fuel ratio at the time of zero current becomes a lean judgement air-fuel ratio which is slightly leaner than the stoichiometric air-fuel ratio.

In this way, in the present embodiment, the sensor applied voltage Vrdwn at the downstream side air-fuel ratio sensor 41 is set to a voltage different from the sensor applied voltage Vrup at the upstream side air-fuel ratio sensor 40, and is alternately set to a voltage higher than and a voltage lower than the sensor applied voltage Vrup at the upstream side air-fuel ratio sensor 40.

Therefore, the ECU 31 which is connected to the two air-fuel ratio sensors 40, 41 judges that the exhaust air-fuel ratio around the upstream side air-fuel ratio sensor 40 is the stoichiometric air-fuel ratio when the output current Irup of the upstream side air-fuel ratio sensor 40 has become zero. On the other hand, the ECU 31 judges that the exhaust air-fuel ratio around the downstream side air-fuel ratio sensor 41 is a rich judgement air-fuel ratio or lean judgement air-fuel ratio, that is, a predetermined air-fuel ratio different from the stoichiometric air-fuel ratio, when the output current Irdwn of the downstream side air-fuel ratio sensor 41 becomes zero. Due to this, the downstream side air-fuel ratio sensor 41 can accurately detect the rich judgement air-fuel ratio and the lean judgement air-fuel ratio.

Note that, as shown in FIG. 18, in the present embodiment, in the state where the sensor applied voltage Vrdwn of the downstream side air-fuel ratio sensor 41 is 0.7V, when the output current Irdwn of the downstream side air-fuel ratio sensor 41 becomes zero or less, the sensor applied voltage Vrdwn of the downstream side air-fuel ratio sensor 41 is changed to 0.2V. Further, in the state where the sensor applied voltage Vrdwn of the downstream side air-fuel ratio sensor 41 is 0.2V, when the output current Irdwn of the downstream side air-fuel ratio sensor 41 becomes zero or more, the sensor applied voltage Vrdwn of the downstream side air-fuel ratio sensor 41 is changed to 0.7V.

Note that, in this Description, the oxygen storage amount of the exhaust purification catalyst is explained as changing between the maximum oxygen storage amount and zero. This means that the amount of oxygen, which can be further stored by the exhaust purification catalyst, changes between zero (when oxygen storage amount is maximum oxygen storage amount) and the maximum value (when oxygen storage amount is zero).

5. combustion chamber
6. intake valve
8. exhaust valve
10. spark plug
11. fuel injector
13. intake branch pipe
15. intake pipe
18. throttle valve
19. exhaust manifold
20. upstream side exhaust purification catalyst
21. upstream side casing
22. exhaust pipe
23. downstream side casing
24. downstream side exhaust purification catalyst
31. ECU
39. air flow meter
40. upstream side air-fuel ratio sensor
41. downstream side air-fuel ratio sensor

The invention claimed is:

1. A control system of an internal combustion engine, the engine comprising an exhaust purification catalyst which is arranged in an exhaust passage of the internal combustion engine and which can store oxygen, the system comprising: a downstream side air-fuel ratio detection device which is arranged at a downstream side, in the direction of flow of exhaust, of said exhaust purification catalyst and which detects the air-fuel ratio of the exhaust gas which flows out from said exhaust purification catalyst, and an air-fuel ratio control system which controls said air-fuel ratio of the exhaust gas so that said air-fuel ratio of the exhaust gas flowing into the exhaust purification catalyst becomes a target air-fuel ratio, the air-fuel ratio control system including an electronic control unit (ECU) having an air-fuel ratio lean switching control, a lean degree lowering control, an air-fuel ratio rich control, and a rich degree lowering control, the ECU configured to:

change said target air-fuel ratio to a lean set air-fuel ratio which is leaner than a stoichiometric air-fuel ratio, when an exhaust air-fuel ratio detected by said downstream side air-fuel ratio detection device becomes a rich air-fuel ratio with the air-fuel ratio lean switching control;

change said target air-fuel ratio to a lean air-fuel ratio with a smaller difference from the stoichiometric air-fuel ratio than said lean set air-fuel ratio with the lean degree lowering control, at a timing after said air-fuel ratio lean switching control changes the air-fuel ratio and before the exhaust air-fuel ratio detected by said downstream side air-fuel ratio detection device becomes the lean air-fuel ratio;

change said target air-fuel ratio to a rich set air-fuel ratio which is richer than the stoichiometric air-fuel ratio with the air-fuel ratio rich switching control, when the exhaust air-fuel ratio detected by said downstream side air-fuel ratio detection device becomes the lean air-fuel ratio; and change said target air-fuel ratio to a rich air-fuel ratio with a smaller difference from the stoichiometric air-fuel ratio than said rich set air-fuel ratio with the rich degree lowering control, at a timing after said air-fuel ratio lean switching control changes the air-fuel ratio and before the exhaust air-fuel ratio detected by said downstream side air-fuel ratio detection device becomes the rich air-fuel ratio.

2. The control system of an internal combustion engine according to claim 1, wherein when changing said target air-fuel ratio change, said lean degree lowering control switches said target air-fuel ratio in step from said lean set air-fuel ratio to the given lean air-fuel ratio with a smaller difference from the stoichiometric air-fuel ratio than said lean set air-fuel ratio.

3. The control system of an internal combustion engine according to claim 1, wherein when changing said target air-fuel ratio change, said rich degree lowering control switches said target air-fuel ratio in step from said rich set air-fuel ratio to the given rich air-fuel ratio with a smaller difference from the stoichiometric air-fuel ratio than said rich set air-fuel ratio.

4. The control system of an internal combustion engine according to claim 1, wherein said lean degree lowering control changes said target air-fuel ratio after the exhaust air-fuel ratio detected by said downstream side air-fuel ratio detection device converges to the stoichiometric air-fuel ratio.

5. The control system of an internal combustion engine according to claim 1, wherein said rich degree lowering control changes said target air-fuel ratio after the exhaust air-fuel ratio detected by said downstream side air-fuel ratio detection device converges to the stoichiometric air-fuel ratio.

6. The control system of an internal combustion engine according to claim 1, further comprising an oxygen storage amount estimating control for estimating said oxygen storage amount of the exhaust purification catalyst, wherein said lean degree lowering control changes said target air-fuel ratio when the oxygen storage amount estimated by said oxygen storage amount estimating control becomes a predetermined storage amount, which is smaller than the maximum oxygen storage amount, or more.

7. The control system of an internal combustion engine according to claim 1, the ECU further comprising an oxygen storage amount estimating control for estimating said oxygen storage amount of the exhaust purification catalyst, wherein said rich degree lowering control changes said target air-fuel ratio when the oxygen storage amount estimated by said oxygen storage amount estimating control becomes a predetermined storage amount, which is larger than zero, or more.

8. The control system of an internal combustion engine according to claim 6, wherein the engine further comprises an upstream side air-fuel ratio detection device which is arranged at an upstream side, in the direction of flow of exhaust, of said exhaust purification catalyst and which detects the exhaust air-fuel ratio of the exhaust gas flowing into the exhaust purification catalyst, wherein said oxygen storage amount estimating control comprises:

an inflowing unburned gas excess/deficient flow amount calculating control for calculating the amount of flow of unburned gas becoming excess or unburned gas becoming deficient compared with the case where said air-fuel ratio of the exhaust gas flowing into the exhaust purification catalyst is the stoichiometric air-fuel ratio, based on the air-fuel ratio detected by said upstream side air-fuel ratio detection device and the intake air amount of said internal combustion engine;

an outflowing unburned gas excess/deficient flow amount calculating control for calculating the amount of flow of unburned gas becoming excess or unburned gas becoming deficient compared with the case where said air-fuel ratio of the exhaust gas flowing out from the exhaust purification catalyst is the stoichiometric air-fuel ratio, based on the air-fuel ratio detected by said downstream side air-fuel ratio detection device and the intake air amount of said internal combustion engine; and a storage amount calculating control for calculating said oxygen storage amount of the exhaust purification catalyst, based on an amount of flow of excessive/deficient unburned gas which is calculated by said inflowing unburned gas excess/deficient flow amount calculating control and an amount of flow of excessive/deficient unburned gas which is calculated by said outflowing unburned gas excess/deficient flow amount calculating control.

9. The control system of an internal combustion engine according to claim 8, the ECU further comprising a learning valve calculating control for calculating a learning value of the air-fuel ratio deviation for correcting deviation of the air-fuel ratio of the exhaust gas which actually flows into the exhaust purification catalyst from said target air-fuel ratio, based on said oxygen storage amount which was calculated by said storage amount calculating control from when said air-fuel ratio lean switching control changes said target air-fuel ratio to a lean set air-fuel ratio to when said air-fuel ratio rich switching control changes said target air-fuel ratio change to a maximum rich air-fuel ratio, and said oxygen storage amount which was calculated by said storage amount calculating control from when said air-fuel ratio lean switching control changes said target air-fuel ratio to a rich set air-fuel ratio to when said air-fuel ratio rich switching control changes said target air-fuel ratio to a lean set air-fuel ratio, wherein said air-fuel ratio control system corrects the target air-fuel ratio which was set by said air-fuel ratio lean switching control, said lean degree lowering control, said air-fuel ratio rich switching control, and said rich degree lowering control, based on the learning value of the air-fuel ratio deviation, which was calculated by said learning value calculating control.

10. The control system of an internal combustion engine according to claim 1, wherein said air-fuel ratio lean switching control judges that the exhaust air-fuel ratio which is detected by said downstream side air-fuel ratio detection device has become the rich air-fuel ratio, when the exhaust air-fuel ratio detected by said downstream side air-fuel ratio detection device becomes a rich judgement air-fuel ratio which is richer than the stoichiometric air-fuel ratio, and said air-fuel ratio rich switching control judges that the exhaust air-fuel ratio which is detected by said downstream side air-fuel ratio detection device has become the lean air-fuel ratio, when the exhaust air-fuel ratio detected by said downstream side air-fuel ratio detection device becomes a lean judgement air-fuel ratio which is leaner than the stoichiometric air-fuel ratio.

11. The control system of an internal combustion engine according to claim 10, wherein said downstream side air-fuel ratio detection device is an air-fuel ratio sensor in which applied voltage, when the output current becomes zero, changes in accordance with the exhaust air-fuel ratio, and said air-fuel ratio sensor is supplied with applied voltage whereby the output current becomes zero when the exhaust air-fuel ratio is said rich judgement air-fuel ratio, and said air-fuel ratio lean switching control judges that the exhaust air-fuel ratio has become the rich air-fuel ratio when said output current becomes zero or less.

12. The control system of an internal combustion engine according to claim 10, wherein said downstream side air-fuel ratio detection device is an air-fuel ratio sensor in which applied voltage, when the output current becomes zero, changes in accordance with the exhaust air-fuel ratio, and said air-fuel ratio sensor is supplied with applied voltage whereby the output current becomes zero when the exhaust air-fuel ratio is said lean judgement air-fuel ratio, and said air-fuel ratio lean switching control judges that the exhaust air-fuel ratio has become the lean air-fuel ratio when said output current becomes zero or less.

13. The control system of an internal combustion engine according to claim 10, wherein said downstream side air-fuel ratio detection device is an air-fuel ratio sensor in which applied voltage, when the output current becomes zero, changes in accordance with the exhaust air-fuel ratio, and wherein said air-fuel ratio sensor is alternately supplied with applied voltage whereby the output current becomes zero when the exhaust air-fuel ratio is said rich judgement air-fuel ratio and with applied voltage whereby the output current becomes zero when the exhaust air-fuel ratio is said lean judgement air-fuel ratio.

14. The control system of an internal combustion engine according to claim 1, the ECU further comprising an upstream side air-fuel ratio detection device which is arranged at an upstream side, in the direction of flow of exhaust, of said exhaust purification catalyst and which detects the exhaust air-fuel ratio of the exhaust gas flowing into the exhaust purification catalyst, wherein said air-fuel ratio control system controls the amount of fuel or air which is fed to the combustion chamber of said internal combustion engine so that the air-fuel ratio which was detected by said upstream side air-fuel ratio detection device becomes said target air-fuel ratio.

15. The control system of an internal combustion engine according to claim 14, wherein said upstream side air-fuel ratio detection device and downstream side air-fuel ratio detection device are air-fuel ratio sensors in which applied voltage, when the output current becomes zero, changes in accordance with the exhaust air-fuel ratio, and wherein the applied voltage at said upstream side air-fuel ratio detection device and the applied voltage said downstream side air-fuel ratio detection device are different values.

16. The control system of an internal combustion engine according to claim 1, further comprising a downstream side exhaust purification catalyst which is arranged at the downstream side, in the direction of flow of exhaust, of said downstream side air-fuel ratio detection device in the exhaust passage and which can store oxygen.

17. The control system of an internal combustion engine according to claim 7, wherein the engine further comprises an upstream side air-fuel ratio detection device which is arranged at an upstream side, in the direction of flow of exhaust, of said exhaust purification catalyst and which detects the exhaust air-fuel ratio of the exhaust gas flowing into the exhaust purification catalyst, wherein said oxygen storage amount estimating control comprises:

an inflowing unburned gas excess/deficient flow amount calculating control for calculating the amount of flow of unburned gas becoming excess or unburned gas becoming deficient compared with the case where said air-fuel ratio of the exhaust gas flowing into the exhaust purification catalyst is the stoichiometric air-fuel ratio, based on the air-fuel ratio detected by said upstream side air-fuel ratio detection device and the intake air amount of said internal combustion engine;

an outflowing unburned gas excess/deficient flow amount calculating control for calculating the amount of flow of unburned gas becoming excess or unburned gas becoming deficient compared with the case where said air-fuel ratio of the exhaust gas flowing out from the exhaust purification catalyst is the stoichiometric air-fuel ratio, based on the air-fuel ratio detected by said downstream side air-fuel ratio detection device and the intake air amount of said internal combustion engine; and a storage amount calculating control for calculating said oxygen storage amount of the exhaust purification catalyst, based on an amount of flow of excessive/deficient unburned gas which is calculated by said inflowing unburned gas excess/deficient flow amount calculating control and an amount of flow of excessive/deficient unburned gas which is calculated by said outflowing unburned gas excess/deficient flow amount calculating control.

18. The control system of an internal combustion engine according to claim 17, the ECU further comprising a learning valve calculating control for calculating a learning value of the air-fuel ratio deviation for correcting deviation of the air-fuel ratio of the exhaust gas which actually flows into the exhaust purification catalyst from said target air-fuel ratio, based on said oxygen storage amount which was calculated by said storage amount calculating control from when said air-fuel ratio lean switching control changes said target air-fuel ratio to a lean set air-fuel ratio to when said air-fuel ratio rich switching control changes said target air-fuel ratio change to a maximum rich air-fuel ratio, and said oxygen storage amount which was calculated by said storage amount calculating control from when said air-fuel ratio lean switching control changes said target air-fuel ratio to a rich set air-fuel ratio to when said air-fuel ratio rich switching control changes said target air-fuel ratio to a lean set air-fuel ratio, wherein said air-fuel ratio control system corrects the target air-fuel ratio which was set by said air-fuel ratio lean switching control, said lean degree lowering control, said air-fuel ratio rich switching control, and said rich degree lowering control, based on the learning value of the air-fuel ratio deviation, which was calculated by said learning value calculating control.

* * * * *